US009855759B2

(12) United States Patent
Kobayashi et al.

(10) Patent No.: US 9,855,759 B2
(45) Date of Patent: Jan. 2, 2018

(54) LIQUID CONTAINER AND LIQUID DISCHARGER

(71) Applicants: Takeyuki Kobayashi, Kanagawa (JP); Tomomi Katoh, Kanagawa (JP); Ryoh Idehara, Kanagawa (JP); Yoichi Ito, Kanagawa (JP); Yoshinori Uchino, Kanagawa (JP)

(72) Inventors: Takeyuki Kobayashi, Kanagawa (JP); Tomomi Katoh, Kanagawa (JP); Ryoh Idehara, Kanagawa (JP); Yoichi Ito, Kanagawa (JP); Yoshinori Uchino, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/350,463

(22) Filed: Nov. 14, 2016

(65) Prior Publication Data

US 2017/0136778 A1 May 18, 2017

(30) Foreign Application Priority Data

Nov. 16, 2015 (JP) ..... 2015-224299

(51) Int. Cl.
*B41J 2/175* (2006.01)
*B41J 29/38* (2006.01)

(52) U.S. Cl.
CPC ..... *B41J 2/17566* (2013.01); *B41J 2/175* (2013.01); *B41J 2/17596* (2013.01); *B41J 29/38* (2013.01); *B41J 2002/17579* (2013.01)

(58) Field of Classification Search
CPC .... B41J 2/17513; B41J 2/175; B41J 2/17596; B41J 2/17556; B41J 2/17566; B41J 2002/17516
See application file for complete search history.

(56) References Cited

U.S. PATENT DOCUMENTS

2004/0135854 A1* 7/2004 Kuwabara ..... B41J 2/17513 347/85
2005/0116997 A1 6/2005 Katoh et al.
(Continued)

FOREIGN PATENT DOCUMENTS

JP 2005-059274 3/2005
JP 2007-045117 2/2007
(Continued)

*Primary Examiner* — Jason Uhlenhake
(74) *Attorney, Agent, or Firm* — Oblon, McClelland, Maier & Neustadt, L.L.P.

(57) ABSTRACT

A liquid container includes a first chamber and a second chamber to contain liquid to be supplied to a head and a liquid path to connect the first chamber and the second chamber so that liquid communicates between the first chamber and the second chamber. Each of the first chamber and the second chamber has a flexible wall. The first chamber includes a first spring inside the first chamber to press the flexible wall of the first chamber outward. The second chamber includes a second spring inside the second chamber to press the flexible wall of the second chamber outward. A pressing force of the first spring is greater than a pressing force of the second spring. A first feeler disposed outside the first chamber and in contact with the flexible wall of the first chamber, and the first feeler is displaced according to a movement of the flexible wall of the first chamber.

12 Claims, 12 Drawing Sheets

(56) References Cited

U.S. PATENT DOCUMENTS

| | | | | |
|---|---|---|---|---|
| 2012/0306950 | A1 | 12/2012 | Kobayashi et al. | |
| 2013/0044148 | A1 | 2/2013 | Kobayashi | |
| 2013/0057604 | A1* | 3/2013 | Masunaga ..... | B41J 29/38 347/6 |
| 2013/0127937 | A1 | 5/2013 | Masunaga et al. | |
| 2013/0135368 | A1 | 5/2013 | Kobayashi et al. | |
| 2013/0135401 | A1 | 5/2013 | Kobayashi et al. | |
| 2013/0147867 | A1 | 6/2013 | Kobayashi et al. | |
| 2014/0204413 | A1 | 7/2014 | Park et al. | |
| 2015/0158308 | A1 | 6/2015 | Kobayashi et al. | |

FOREIGN PATENT DOCUMENTS

| | | |
|---|---|---|
| JP | 2011-207206 | 10/2011 |
| JP | 2012-61680 | 3/2012 |
| JP | 2013-193246 | 9/2013 |

* cited by examiner

LIQUID CONTAINER AND LIQUID DISCHARGER

CROSS-REFERENCE TO RELATED APPLICATIONS

The present application claims priority from Japanese patent application number 2015-224299, filed on Nov. 16, 2015, the entire contents of which are incorporated herein by reference.

BACKGROUND

Field

The present disclosure relates to a liquid container and a liquid discharger, and in particular relates to a liquid discharger including a head to discharge liquid droplets and a liquid container to supply liquid to the head.

Description of the Related Art

Using a liquid discharger that includes a carriage, which mounts a head and a sub-tank (head tank) to supply liquid to the head and scans in a main scanning direction, an apparatus that is able to supply liquid from a main-tank to the sub-tank while the carriage scans in the main scanning direction is known.

For example, Japanese Patent Open No. 2012-61680 discloses an apparatus that has a displacement member (hereinafter, also referred to as a feeler), which displaces according to a remaining amount of liquid in the sub-tank (hereinafter, also referred to as a head tank). The apparatus has a first sensor disposed on the carriage and a second sensor disposed on the apparatus body. The first sensor detects whether the displacement member displaces to a predetermined first position. The second sensor detects whether the displacement member displaces to a predetermined second position.

Further, the apparatus detects and stores a differential amount corresponding to a distance between the first position and the second position. The apparatus starts supplying liquid when the displacement member displaces to a predetermined supply start position while the carriage scans, and the apparatus supplies liquid of the differential amount after the first sensor detects the displacement member.

However, this type of apparatus configuration, which has a sensor on the carriage to detect the displacement member, increases the size of the carriage, and causes a decrease in carriage scanning speed. Also, this type of apparatus configuration has a complex structure resulting in increased manufacturing cost.

SUMMARY

The present disclosure provides an improved liquid discharger capable of supplying liquid while the liquid container moves together with the carriage, which scans in the main scanning direction.

The liquid discharger according to preferred embodiments of the present disclosure includes a first chamber and a second chamber to contain liquid to be supplied to a head and a liquid path to connect the first chamber and the second chamber so that liquid communicates between the first chamber and the second chamber. The first chamber and the second chamber each have a flexible wall and the first chamber includes a first spring inside the first chamber to press the flexible wall of the first chamber outward and the second chamber includes a second spring inside the second chamber to press the flexible wall of the second chamber outward. A pressing force of the first spring is greater than a pressing force of the second spring. Also, the liquid container includes a first feeler disposed outside the first chamber and in contact with the flexible wall of the first chamber, the first feeler being displaced according to a movement of the flexible wall of the first chamber.

BRIEF DESCRIPTION OF THE DRAWINGS

These and other objects, features, and advantages of the present disclosure will become more readily apparent upon consideration of the following description of the preferred embodiments when taken in conjunction with the accompanying drawings, wherein.

DETAILED DESCRIPTION

Figure 1:
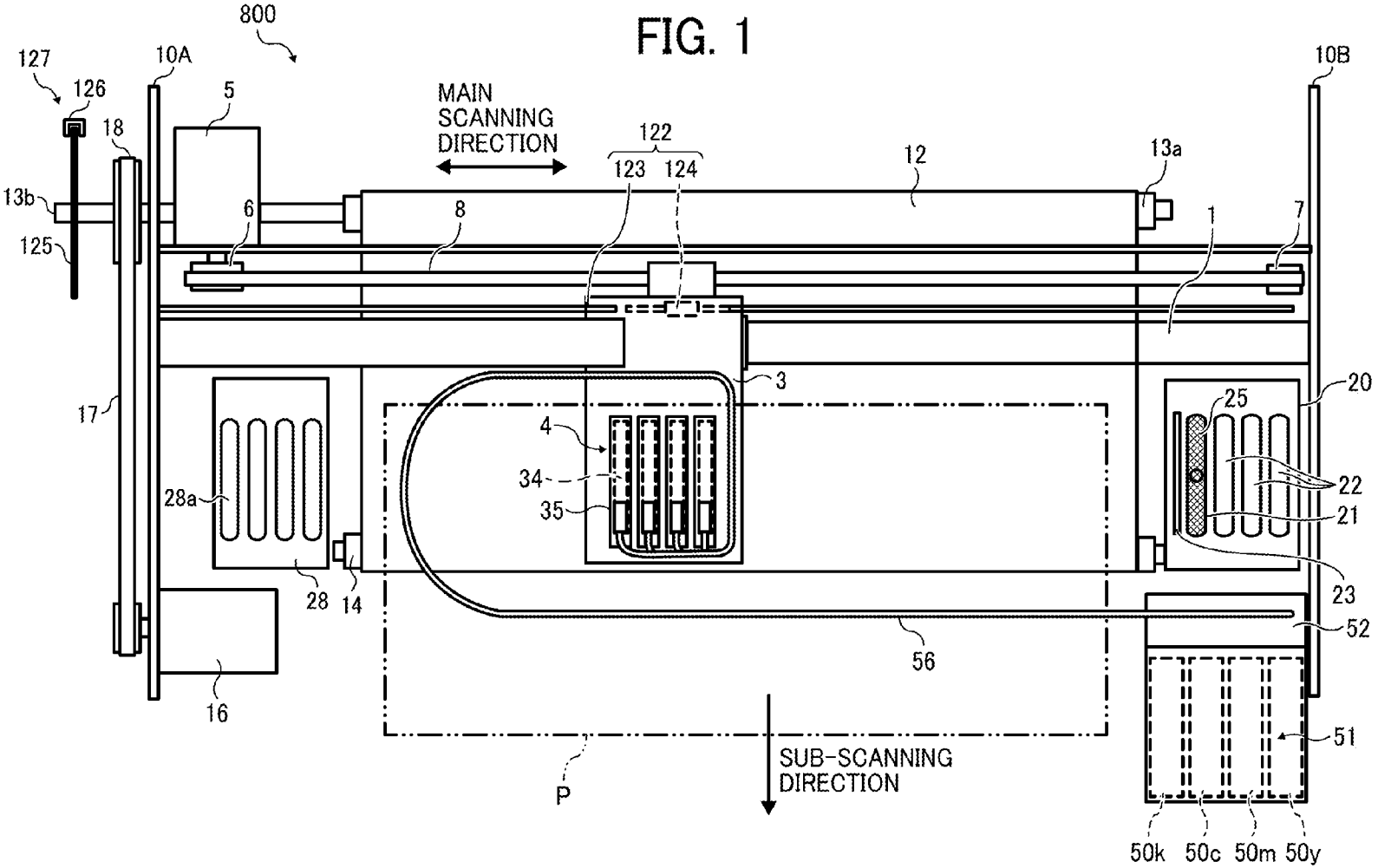
FIG. 1 is an explanatory plan view of a structural part of a liquid discharger.
Figure 2:
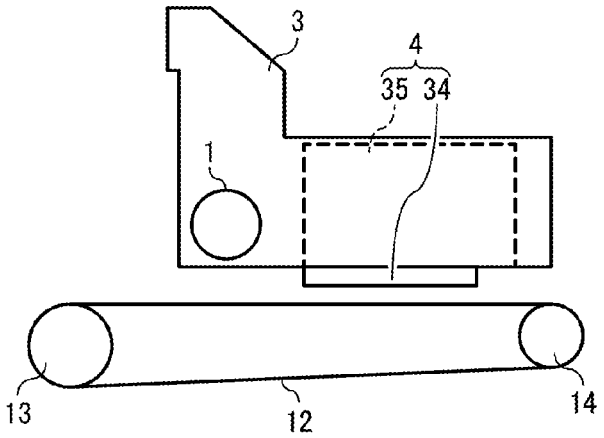
FIG. 2 is an explanatory side view of a main part of the liquid discharger in FIG. 1.
Figure 3:
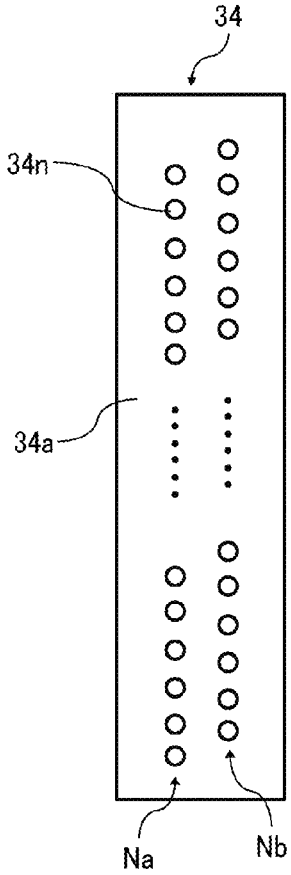
FIG. 3 is an explanatory plan view for explaining a head structure.

Hereinafter, preferred embodiments will now be described with reference to the accompanying drawings. First, an example of a liquid discharger will be described with reference to FIGS. 1 to 3. FIG. 1 is an explanatory plan view of a structural part of a liquid discharger. FIG. 2 is an explanatory side view of a main part of a liquid discharger in FIG. 1. FIG. 3 is an explanatory plan view for explaining a head structure.

The liquid discharger 800 is a serial-type liquidjet apparatus, including side plates 10A and 10B disposed at lateral sides of the apparatus, a guide rod 1 horizontally mounted on the lateral side plates 10A and 10B, and a carriage 3 held by the guide rod 1 and slidably movable in a main scanning direction by a main scanning motor 5 via a timing belt 8 wound between a drive pulley 6 and a driven pulley 7.

The carriage 3 mounts four liquid discharge units 4. Each of the liquid discharge units 4 has a head 34 and a head tank 35 unified as one body.

As shown in FIG. 3, the heads 34 each include two nozzle arrays Na and Nb arranged in a sub-scanning direction perpendicular to the main scanning direction on a nozzle surface 34*a*. Each nozzle array Na and Nb has plurality of nozzles 34*n*, from which liquid is discharged. For example, the four heads 34 discharge liquid droplets of yellow (Y), cyan (C), magenta (M), and black (K), respectively.

The carriage 3 includes four head tanks 35 that supply liquid of respective colors corresponding to each of the four heads 34. Each head tank 35 is an example of "a liquid container" as recited in the claims.

As shown in FIG. 1, the liquid discharger 800 includes a cartridge holder 51 fixed at the apparatus body. The cartridge holder 51 mounts four exchangeable main tanks 50*y*, 50*m*, 50*c*, and 50*k*, each of which contains a liquid of a respective color.

The cartridge holder 51 includes a supply pump 52 that supplies liquid of respective colors to the corresponding head tanks 35 via the corresponding supply tubes 56 from the corresponding main tanks 50*y*, 50*m*, 50*c*, and 50*k*.

The liquid discharger 800 includes a conveyance belt 12 that conveys a sheet P by electrostatically attracting the sheet P and conveys the sheet P to a position facing to the heads 34. The conveyance belt 12 is an endless belt stretching over a conveyance roller 13 and a tension roller 14, and is configured so as to rotate in a belt conveyance direction (i.e., a sub-scanning direction).

In addition, as shown in FIG. 2, the liquid discharger 800 has a charge roller 802, which is a charging means to charge a surface of the conveyance belt 12. A power source 804 applies an alternate voltage, which is an alternate repetition of positive and negative voltages, to the charge roller 802. The charge roller 802 is disposed in contact with the surface layer of the conveyance belt 12 and is driven to rotate by the rotation of the conveyance belt 12.

Thus, the conveyance belt 12 is charged in an alternate charge pattern, in which a positive charge and a negative charge is alternately applied with predetermined widths in a strip shape in the sub-scanning direction, which is the direction of rotation of the conveyance belt 12. When the sheet P is fed on the thus alternately charged conveyance belt 12, the sheet P is attracted to the conveyance belt 12 and is conveyed in the sub-scanning direction by the rotational movement of the conveyance belt 12.

A sub-scanning motor 16 drives and rotates the conveyance roller 13 via the timing belt 17 and the timing pulley 18 to rotate the conveyance belt 12 in a belt conveyance direction (i.e., a sub-scanning direction).

The liquid discharger 800 includes a maintenance mechanism 20 to maintain the nozzles 34*n* of the heads 34 in good condition at a non-print area at one side of the conveyance belt 12 in the main scanning direction of the carriage 3.

The liquid discharger 800 includes an idle discharge receiver 28 at another side of the conveyance belt 12. The idle discharge receiver 28 is disposed at a non-print area at an opposite side of the maintenance mechanism 20 in the main scanning direction of the carriage 3. The idle discharge receiver 28 receives liquid droplets discharged from the nozzles 34*n* of the head 34 for an idle discharge operation. The idle discharge operation discharges liquid inside the nozzles 34*n* having an increased viscosity for maintaining or recovering a function of the heads 34 and not for contributing to the recording or image forming process. The idle discharge receiver 28 includes openings 28*a* aligned in the nozzle array direction of the heads 34.

The maintenance mechanism 20 includes a suction cap 21, three moisture caps 22; and a wiper blade 23. The suction cap 21 and the moisture caps 22 cap nozzle surface 34*a* of the heads 34. The suction cap 21 sucks liquid from the nozzles 34*n* of the heads 34. The moisture caps 22 cap nozzle surface 34*a* of the head to keep moisture inside the nozzles 34*n* of the head 34. The suction cap 21 also functions as a moisture cap when not performing a suction process. The suction cap 21 includes absorber 25 to absorb liquid suctioned from the nozzles 34*n* during the suction process. The wiper blade wipes the nozzle surface 34*a* of the heads 34.

The liquid discharger 800 further includes an encoder scale 123 and an encoder sensor 124 that form a linear encoder (or main scanning encoder) 122 to detect the position of the carriage 3 in the main scanning direction (or the carriage position), and displacement amount of the carriage 3 can be detected from a detection signal of the linear encoder sensor 122.

The encoder scale 123, on which a predetermined pattern is formed, is stretched between the lateral side plates 10A and 10B in the main scanning direction of the carriage 3. The encoder sensor 124 has a light-penetration type photo sensor that reads the predetermined pattern formed on the encoder scale 123.

A code wheel 125 is mounted on the axis 13*b* of the roller 13*a*. An encoder sensor 126 has a light-penetration type photo sensor to read a pattern formed around a periphery of the code wheel 125. The encoder sensor 126 and the code wheel 125 comprise a rotary encoder 127 (a sub-scanning encoder) to detect an amount of movement and a movement position of the conveyance belt 12.

When the sheet P is fed on the alternately charged conveyance belt 12, the sheet P is attracted to the conveyance belt 12 and is conveyed in the sub-scanning direction by the rotational movement of the conveyance belt 12 in this configuration of the liquid discharger 800.

Then, the heads 34 are driven in response to image signals while moving the carriage 3 in the main scanning direction so as to discharge liquid droplets onto the stopped sheet P to record a single line. After the sheet P is conveyed by a predetermined distance, recording of a next line is performed.

Upon reception of a recording end signal or a signal indicating that a rear end of the sheet P has reached the recording area, the recording operation is terminated and the sheet P is discharged to the sheet discharge tray 806.

When the maintenance and recovery of the heads 34 is performed, the carriage 3 is moved to a home position where the maintenance mechanism 20 is located, and capping by the suction cap 21 and moisture caps 22 is performed. Then, maintenance and recovery operations such as suction of nozzles 34*n* by the suction cap 21 and idle discharge by the idle discharge receiver 28 are performed, thereby forming a quality image by a stable liquid droplet discharge.

Figure 5:
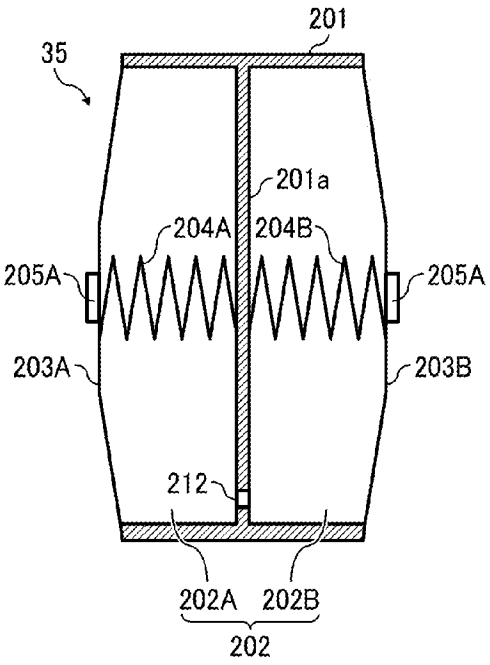
FIG. 5 is an schematic front cross section illustrating a main part of a head tank.
Figure 4:
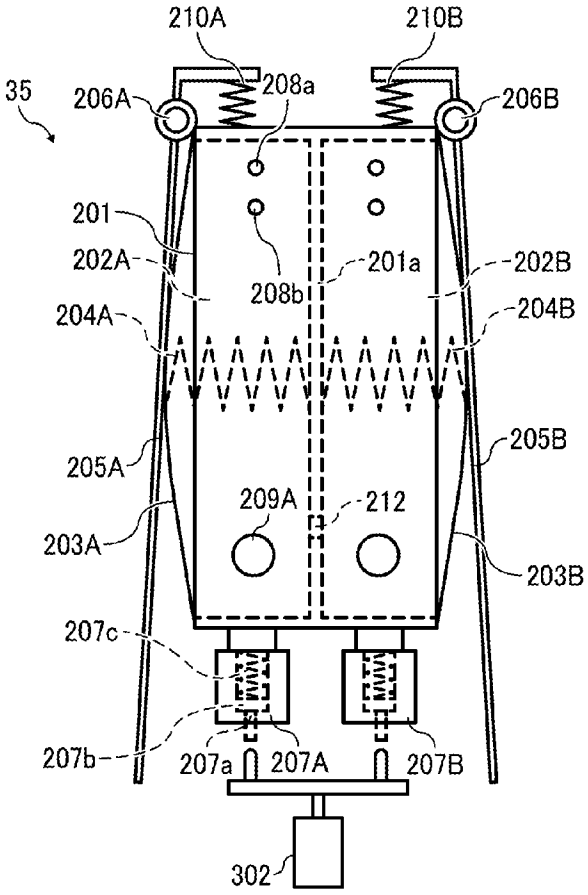
FIG. 4 is a schematic plan view of a head tank in a first embodiment.

Next, the head tank 35, which is a liquid container of the first embodiment, will be described with reference to FIGS. 4 and 5. FIG. 4 is a schematic plan view of the head tank 35 and FIG. 5 is a schematic front view of the same.

The head tank 35 includes a first chamber 202A and a second chamber 202B, which are two liquid containing parts (tank parts) that accommodate liquid inside a tank case 201. The first chamber 202A and the second chamber 202B form a liquid containing part 202.

The tank case 201 includes openings on both sides of the tank case 201 and a partition wall 201*a* at the center of the tank case 201. Each of the openings of the tank case 201 is sealed with a first film 203A and a second film 203B. The first film 203A and the second film 203B are flexible and able to be restored to an original form. Hereinafter, the first film 203A and the second film 203B are collectively referred as "a film 203".

Thereby, the first chamber 202A and the second chamber 202B are formed by the partition wall 201*a* that separates the tank case 201 into two rooms and the first film 203A and the second film 203B, which seal the openings formed on both sides of the tank case 201.

The tank case 201 includes a liquid path 212 that connects the first chamber 202A and the second chamber 202B so that liquid communicates between the first chamber 202A and the second chamber 202B. A vertical position of the liquid path 212 on the partition wall 201*a* is arranged such that the liquid path 212 is always located below the liquid surface of both of the first chamber 202A and the second chamber 202B. That is, the liquid path 212 is always located below the liquid level in the first chamber 202A and the second chamber 202B.

A first spring 204A as an elastic member disposed inside the first chamber 202A constantly pushes the first film 203A outward. With this structure, because the first film 203A of the tank case 201 is pressed outward by the first spring 204A, if the remaining amount of the liquid inside the first chamber 202A of the tank case 201 is reduced, a negative pressure is generated.

A first feeler 205A disposed outside the first chamber 202A of the tank case 201 is swingably supported by a support shaft 206A at one end thereof.

The first feeler 205A is press-contacted against the outside surface of the first film 203A of the tank case 201 by the third spring 210A. Thereby, the first feeler 205A is displaced in conjunction with a movement of the first film 203A, which deforms according to the remaining amount of the liquid inside the first chamber 202A.

The remaining amount of the liquid and negative pressure inside the head tank 35 can be obtained by detecting the first feeler 205A by a body side sensor 301 disposed on the apparatus body, which will be described later.

A second spring 204B as an elastic member disposed inside the second chamber 202B constantly pushes the second film 203B outward. With this structure, because the second film 203B of the tank case 201 is pressed outward by the second spring 204B, if the remaining amount of the liquid inside the second chamber 202B of the tank case 201 is reduced, a negative pressure is generated.

A second feeler 205B disposed outside the second chamber 202B of the tank case 201 is swingably supported by a support shaft 206B at one end thereof.

The second feeler 205B is press-contacted against the outside surface of the second film 203B of the tank case 201 by the fourth spring 210B. Thereby, the second feeler 205B is displaced in conjunction with a movement of the second film 203B, which deforms according to the remaining amount of the liquid inside the second chamber 202B.

Here, a pressing force of the first spring 204A is greater than a pressing force of the second spring 204B.

Further, a pressing force of the third spring 210A is greater than a pressing force of the fourth spring 210B.

Further, supply ports 209A and 209B, through each of which the liquid is supplied from the main tanks 50*k*, 50*c*, 50*m*, and 50*y* to the first chamber 202A and the second chamber 202B, are disposed at an upper part of the tank case 201. Each of the supply port 209A and 209B is connected to the supply tubes 56. In addition, air release units 207A and 207B to expose an interior of the first chamber 202A and the second chamber 202B of the head tank 35 to the atmosphere are disposed at a side of the tank case 201.

Each of the air release unit 207A and 207B includes an air release path 207*c* communicating to an interior of the first chamber 202A and the second chamber 202B of the head tank 35, valves 207*d* configured to open or close the air release path 207*c*, and a spring 207*e* to press the valve 207*d* to close the air release path 207*c*.

When an air release solenoid 302 disposed at the apparatus body presses and opens the valves 207*d* of each of the air release unit 207A and 207B, the air inside the first chamber 202A and the second chamber 202B of the head tank 35 is allowed to be released to the atmosphere, i.e., in a state communicating to the environmental atmosphere.

Electrode pins 208*a* and 208*b* also disposed at each of the first chamber 202A and the second chamber 202B to detect a height of the liquid surface inside the first chamber 202A and the second chamber 202B of the head tank 35. Because the liquid has conductivity, when the liquid surface reaches the electrode pins 208*a* and 208*b*, electric current flows between the electrode pins 208*a* and 208*b* and a resistance value of each electrode pin changes. With this structure, that the height of the liquid level inside the first chamber 202A and the second chamber 202B of the head tank 35 has decreased to a predetermined height or below, or that the air amount inside the first chamber 202A and the second chamber 202B of the head tank 35 has increased to a predetermined amount can be detected.

Figure 6B:
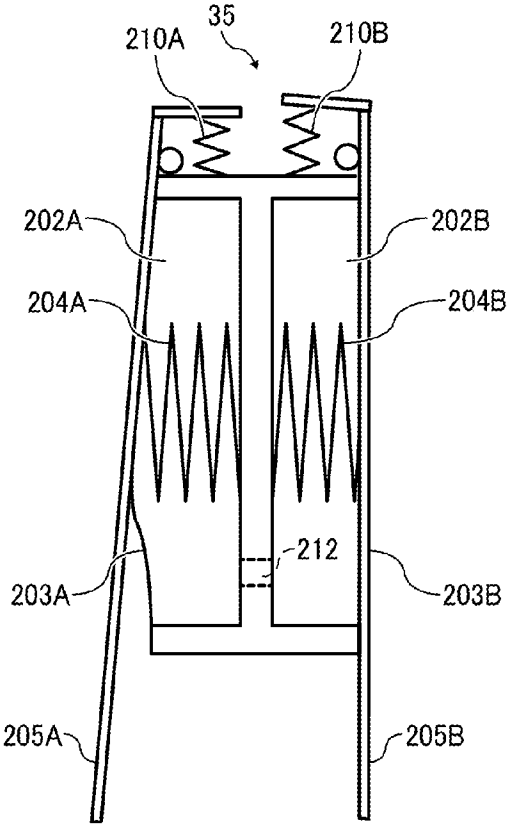
FIGS. 6A and 6B are schematic plan views for explaining an operation of the head tank.
Figure 6A:
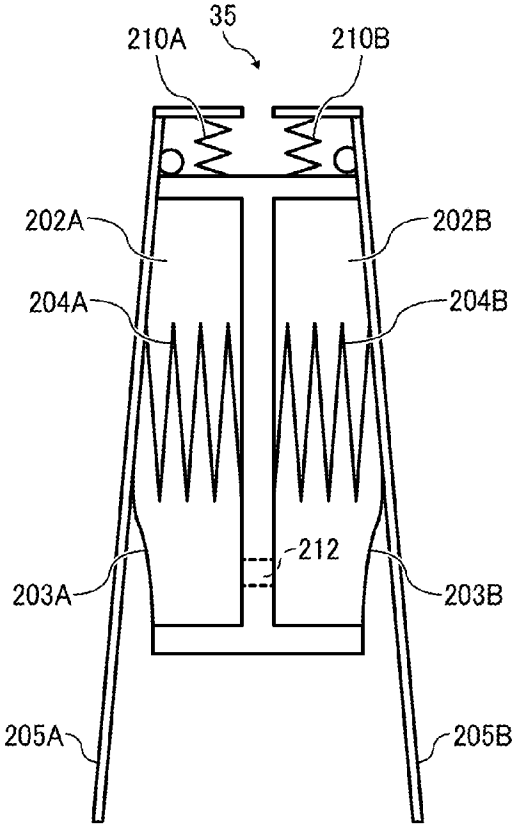

Next, an operation of the head tank 35 in the present liquid discharger 800 will now be described with reference to FIGS. 6A and 6B. FIGS. 6A and 6B are schematic plan views for explaining an operation of the head tank. The head tank 35 shown in the following figures is shown simplified.

As shown in FIG. 6A, because the liquid path 212 connects the first chamber 202A and the second chamber 202B so that liquid communicates between the first chamber 202A and the second chamber 202B, the negative pressures in each of the first chamber 202A and the second chamber 202B are kept at a same value.

Here, the pressing force of the first spring 204A in the first chamber 202A is greater than the pressing force of the second spring 204B in the second chamber 202B.

Therefore, if the negative pressure increases by discharging liquid in the first chamber 202A and the second chamber 202B of the head tank 35 from the nozzles 34*n* of the heads 34, the second spring 204B contracts faster than the first spring 204A. Further, the second film 203B also contracts and deforms toward the inside the second chamber 202B with the deformation of the second spring 204B.

With this deformation of the second spring 204B and the second film 203B, the second feeler 205B displaces faster than the first feeler 205A in a direction toward inside the head tank 35 so that liquid amount in the head tank 35 decreases. This displacing direction of the feeler 205 is called as "a contraction direction."

Then, when the pressing force of the second spring 204B that presses the second film 203B of the second chamber 202B becomes equal to the pressing force of the first spring 204A that presses the first film 203A of the first chamber 202A, or when the second feeler 205B contacts the tank case 201 and cannot displace it, the first spring 204A starts to contract and the first feeler 205A starts to displace.

Therefore, when the first feeler 205A starts to displace or displaces for a predetermined amount, the liquid discharger 800 starts to supply liquid to the head tank 35 from the main tanks 50*k*, 50*c*, 50*m*, and 50*y*, and it is thereby possible to always keep the condition that more than a predetermined amount of liquid is contained inside the liquid containing part 202 formed by the first chamber 202A and the second chamber 202B.

Thus, it is possible to control the liquid supply operation when the head tank 35 moves together with the carriage 3 only by detecting the first feeler 205A by the body side sensor 301 disposed on the apparatus body. Thus, the structure for controlling the liquid supply operation can be simplified.

In this case, if both of the first feeler 205A and the second feeler 205B are pushed strongly against the first film 203A and the second film 203B toward the inside the first chamber 202A and the second chamber 202B by the third spring 210A and the fourth spring 210B, respectively, the pressing forces of the first spring 204A and the second spring 204B decrease, so that the correlation between the negative pressure inside the head tank 35 and the liquid amount inside the head tank 35 also becomes complicated.

Therefore, it is preferable to set a pressing force of each of the third spring 210A and the fourth spring 210B that presses the first feeler 205A and the second feeler 205B against the first film 203A and the second film 203B, respectively, such that the pressing force of each of the third spring 210A and the fourth spring 210B does not influence a pressing force of each of the first spring 204A and the second spring 204B.

However, if the pressing force of each of the third spring 210A and the fourth spring 210B that presses the first feeler 205A and the second feeler 205B against the first film 203A and the second film 203B is too small, the first feeler 205A and the second feeler 205B may not contact the first film 203A and the second film 203B, respectively, by the surrounding environment, such as micro-vibration. Then, the body side sensor 301 cannot detect the displacement of the first feeler 205A and the second feeler 205B correctly.

Therefore, because the pressing force of the first spring 204A is set to be greater than the pressing force of the second spring 204B, the pressing force of the third spring 210A that presses the first feeler 205A against the first film 203A is set to be greater than the pressing force of the fourth spring 210B that presses the second feeler 205B against the second film 203B.

Figure 7:
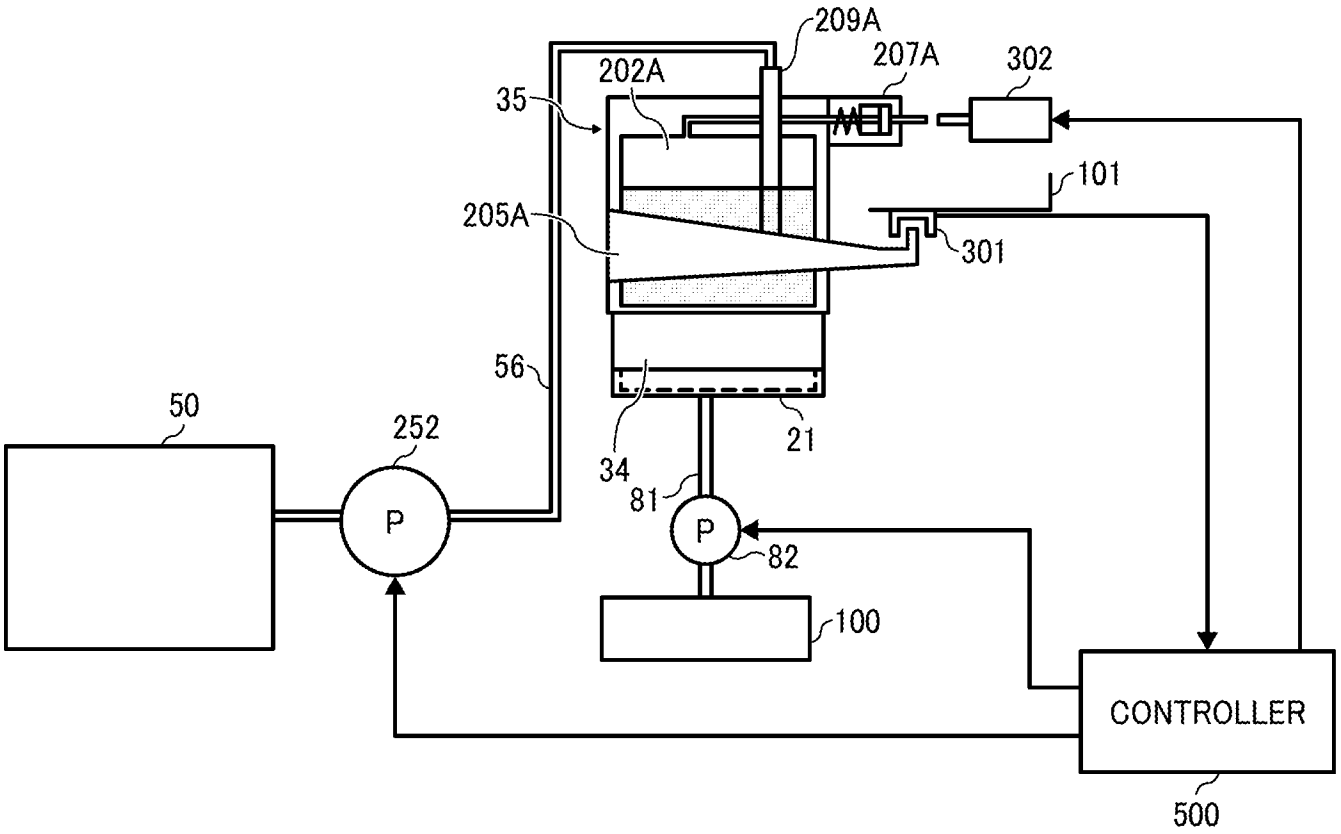
FIG. 7 is a schematic side view of a liquid supply and a liquid discharge system of a liquid discharger.

Next, a liquid supply and a liquid discharge system in the liquid discharger 800 will be explained with referring to FIG. 7. FIG. 7 is a schematic side view of a liquid supply and a liquid discharge system of the liquid discharger 800.

The supply pump 52 includes a liquid feed pump 252 serving to convey the liquid. First, supplying the liquid from the main tanks 50*y*, 50*m*, 50*c*, and 50*k* to the head tank 35 is performed via the supply tube 56 by the liquid feed pump 252. The liquid feed pump 252 is a reversible pump formed of a tube pump and performs both an operation to supply liquid from the main tanks 50*y*, 50*m*, 50*c*, and 50*k* to the head tank 35 and an operation to return liquid from the head tank 35 to the main tanks 50*y*, 50*m*, 50*c*, and 50*k*.

Further, the maintenance mechanism 20 includes a suction cap 21 to cap the nozzle surface 34*a* of the head 34 and a suction pump 82 connected to the suction cap 21. When the suction pump 82 is driven in a state that the nozzle surface 34*a* is capped with the suction cap 21, the liquid is sucked from the nozzle 34*n* via the suction tube 81 and the liquid inside the head tank 35 can be sucked. The sucked waste liquid is discharged to a waste tank 100.

An air release solenoid 302, a pressing member disposed on the apparatus body 101, serves to open or close the air release unit 207A of the head tank 35. By operating the air release solenoid 302, the air release unit 207A can be opened or closed, and the air inside the head tank 35 can be released to the atmosphere outside the head tank 35 by opening of the air release unit 207A.

The body side sensor 301, an optical sensor configured to detect the first feeler 205A and the second feeler 205B is disposed on the apparatus body 101. The liquid supplying operation from the main tanks 50*y*, 50*m*, 50*c*, and 50*k* to the head tank 35 and an operation to return liquid from the head tank 35 to the main tanks 50*y*, 50*m*, 50*c*, and 50*k* is controlled by using detection results of the body side sensor 301 and detection result of the linear encoder 122.

The driving of the liquid feed pump 252, air release solenoid 302, and suction pump 82 and the liquid supplying operation according to the present invention are controlled by a controller 500.

Figure 8:
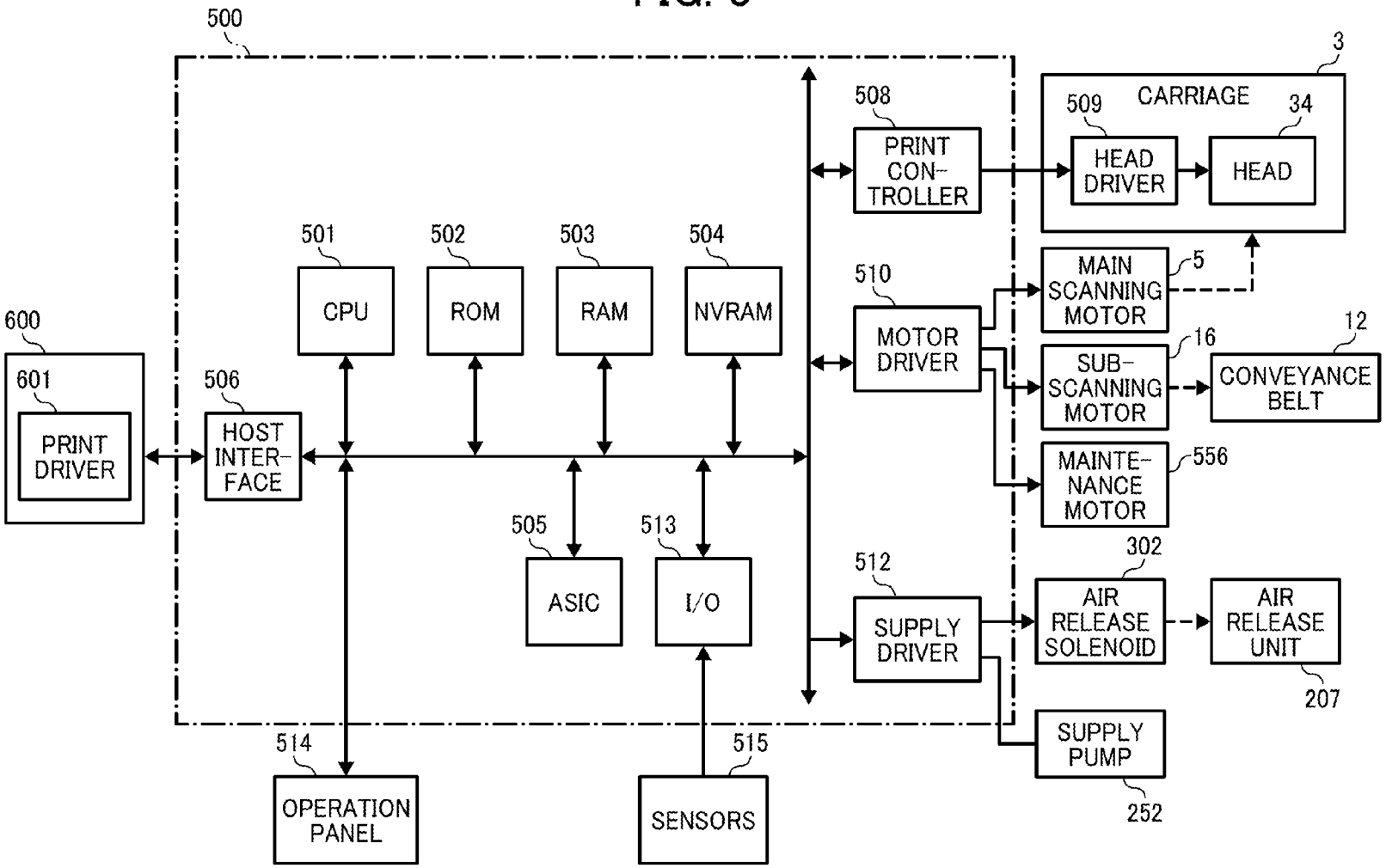
FIG. 8 is a block diagram illustrating a controller of a liquid discharger.

Next, an outline of the controller 500 in the liquid discharger 800 will now be described with reference to FIG. 8. FIG. 8 is an overall block diagram of the controller 500.

The controller 500 controls the apparatus entirely and includes a CPU 501; various programs performed by the CPU 501; a read-only memory (ROM) 502 storing various fixed data; a random access memory (RAM) 503 temporarily storing image data; a rewritable nonvolatile memory 504 capable of holding data while the power to the apparatus is being shut down; and an ASIC 505 configured to handle various signals to the image data, image processing to perform rearrangement and the like, and input/output signals to control the entire apparatus.

The controller 500 further includes a data transmitter to drive and control the head 34; a print controller 508 including a drive signal generator; a head driver or driver IC 509, disposed on the carriage 3, to drive the head 34;

The controller 500 further controls a main scanning motor 5 to move the carriage 3 to scan; a sub-scanning motor 16 to move to circulate the conveyance belt 12; a motor driver 510 to drive a maintenance motor 556 of the maintenance mechanism 20. The maintenance motor 556 performs to drive the suction pump 82 and drive the caps 21 and 22 and the wiper blade 23 to move vertically.

The controller 500 further controls the air release solenoid 302, disposed on the apparatus body 101, to open/close the air release unit 207A of the head tank 35; and includes a supply system driver 512 to drive the liquid feed pump 252, and the like.

In addition, an operation panel 514 for inputting necessary information to the apparatus and displaying the information thereon is connected to the controller 500.

An I/O 513 obtains information from various other sensors 515 attached to the apparatus, and extracts necessary information to control an entire printer including the print controller 508, the motor driver 510, and liquid supply control to the head tank 35.

The other sensors 515 includes the body side sensor 301, the electrode pins 208*a* and 208*b*, an optical sensor to detect a position of the sheet P, a thermistor (an environment temperature sensor, an environment humidity) to monitor temperature and humidity inside the apparatus body, a sensor to monitor voltage of the conveyance belt 12, and interlock switch to detect open/close of the cover. The I/O 513 performs controlling various sensors information.

The controller 500 further includes an I/F 506 through which data and signals are transmitted between a host and the apparatus. The I/F 506 receives data and signals via a cable or a network from the host 600 including an information processor such as a PC, an image reader such as an image scanner, a picture capturing device such as a digital camera, and the like.

The CPU 501 of the controller 500 reads and analyzes print data in a reception buffer included in the I/F 506, causes the ASIC 505 to perform necessary image processing and data rearrangement processing, and transfers the processed image data from the print controller 508 to the head driver 509. There is provided a printer driver 601 at a side of the host 600. The printer driver 601 generates dot pattern data for outputting an image.

The print controller 508 transmits the above image data as serial data as well as outputs transfer clock signals, latch signals, and control signals necessary to transfer the image data and ensure that the image transfer has been performed, to the head driver 509. The print controller 508 further includes a drive signal generator formed of a D/A converter to perform digital-to-analog conversion of pattern data of driving pulses stored in the ROM, voltage and current amplifiers, and the like, and outputs drive signals formed of a drive pulse or a plurality of drive pulses to the head driver 509.

The drive pulse is a drive signal given from the print controller 508 based on the image data corresponding to one line of data serially input to the head 34. The head driver 509 selectively applies the drive pulse to a drive element (for example, a piezoelectric element) that generates energy to have the head 7 to discharge the liquid droplets, thereby driving the head 34. In this operation, by selecting a drive pulse to formulate a drive signal, dots with various sizes such as a large dot, a medium dot, and a small dot can be selectively formed.

Figure 9:
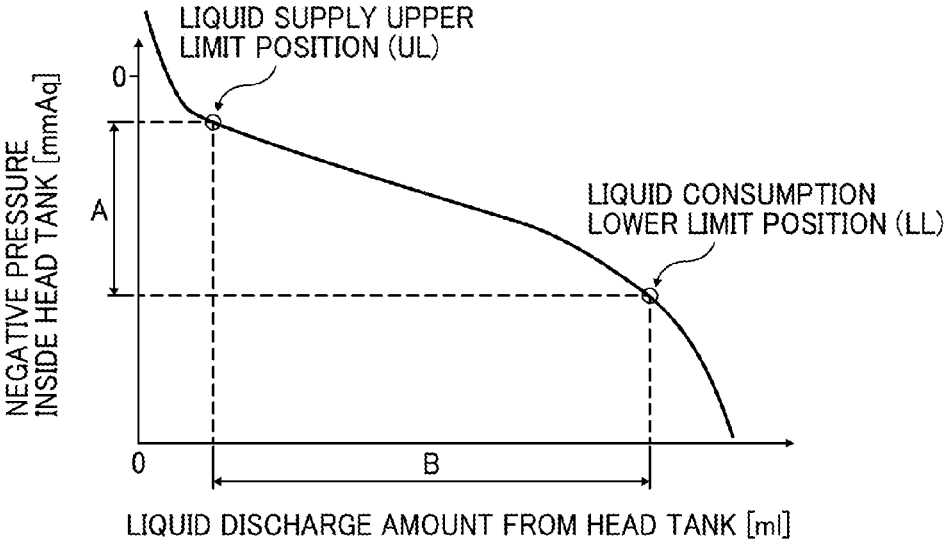
FIG. 9 is an explanatory view illustrating an example of relationship between a liquid discharge amount and a pressure inside a head tank for explaining a negative pressure control of a head tank.

Next, a negative pressure forming operation in the head tank 35 in the thus-configured liquid discharger 800 will now be described referring to FIG. 9. FIG. 9 is an explanatory view illustrating an example of a relationship between a liquid discharge amount from the head tank 35 and a pressure inside a head tank 35.

As described above, while liquid is supplied to the head tank 35, liquid is discharged from the nozzles of the head tank 35 by a sucking operation or fed in reverse from the head tank 35 to the main tank 10 by the liquid feed pump 252. As a result, the first film 203A is pulled inward of the head tank 35 against the restoring force of the first spring 204A, thus compressing the first spring 204A and increasing the negative pressure in the head tank 35. From this state, when liquid is supplied to the head tank 35, the first film member 203A is pushed outward, thus expanding the first spring 204A and reducing the negative pressure in the head tank 35.

Here, if the negative pressure in the head tank 35 is too weak (low), liquid might leak from the nozzles of the head 34. By contrast, if the negative pressure in the head tank 35 is too strong (high), air or dust might be sucked from the nozzles 34*n* to the inside of the head tank 35, thus causing discharge failure. In addition, to maintain a meniscus form suitable for desirable droplet discharge, the negative pressure (pressure) in the head tank 35 needs be controlled within a certain range.

The control of the liquid amount inside the liquid containing part 202 (hereinafter, merely referred as "inside the head tank 35") of the head tank 35 serves also to control the negative pressure inside the head tank 35. That is, as shown in FIG. 9, the negative pressure inside the head tank 35 has a correlation with the liquid discharge amount from the head tank 35. When the liquid discharge amount from the head tank 35 is small, the liquid remaining amount is large, and the negative pressure inside the head tank 35 is low. On the other hand, when the liquid discharge amount from the head tank 35 is large, the liquid remaining amount is small, and the negative pressure inside the head tank 35 is high.

Therefore, the controller 500 controls the liquid supply to the head tank 35 such that the liquid discharge amount from the head tank 35 is within a predetermined range of a liquid discharge amount B, and the negative pressure inside the head tank 35 is within a predetermined negative pressure control range A, as shown in FIG. 9.

In other words, as illustrated in FIG. 9, the negative pressure in the head tank 35 correlates with the amount of liquid in the head tank 35. The greater the amount of liquid in the head tank 35, the smaller (weaker) the negative pressure in the head tank 35. The smaller the amount of liquid in the head tank 35, the greater (stronger) the negative pressure in the head tank 35.

Hence, in this exemplary embodiment, as illustrated in FIG. 9, the controller 500 controls the liquid supply to the head tank 35 so that the amount of liquid discharged from the head tank 35 is maintained within a range B (discharged liquid amount range B) and the negative pressure in the head tank 35 is maintained within a range A (negative-pressure control range A).

The amount of liquid discharged from the head tank 35 corresponding to a minimum value (relatively small values of negative pressure and discharged liquid amount) of the negative-pressure control range A is defined as the "liquid supply upper limit position UL" with respect to the displacement position of the first feeler 205A ("liquid supply upper limit value" regarding the amount of liquid). By contrast, the amount of liquid discharged from the head tank 35 corresponding to a maximum value (relatively large values of negative pressure and discharged liquid amount) of the negative-pressure control range A is defined as the "liquid consumption lower limit position LL" with respect to the displacement position of the first feeler 205A ("liquid consumption lower limit value" regarding the amount of liquid).

Next, how to set the liquid amount inside the head tank 35 to the fill-up position will be described referring to FIGS. 10A to 10C. In the following figures, a schematic side views of the head tank 35 are shown for explanation.

Figure 10A:
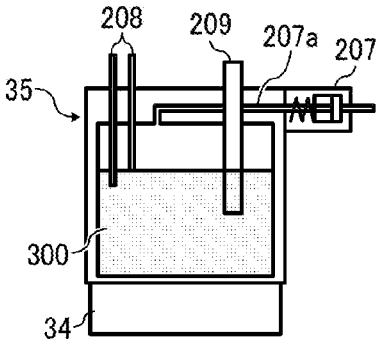
FIGS. 10A, 10B and 10C are a schematic side views for explaining a method for filling up a head tank.
Figure 10B:
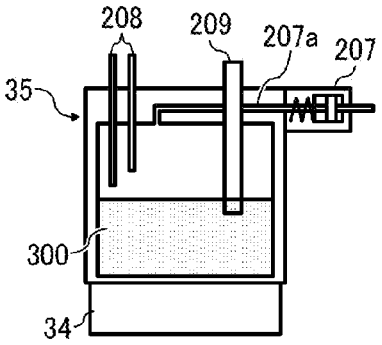

In order to set the liquid amount inside the head tank 35 to the fill-up position, from a state as illustrated in FIG. 10A, by releasing the negative pressure inside the liquid containing part 202 of the head tank 35, the air release unit 207A is opened and a liquid level in the head tank 35 lowers, as illustrated in FIG. 10B.

Figure 10C:
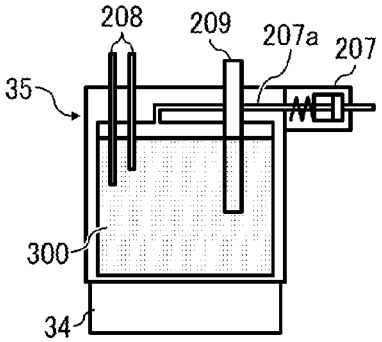

After the negative pressure in the liquid containing part 202 of the head tank 35 is released and the liquid level lowers, the controller supplies the liquid 300 to the liquid containing part 202 of the head tank 35, as illustrated in FIG. 10C. When the liquid 300 is supplied, the liquid level is elevated, and the controller 500 continues to supply the liquid 300 until the electrode pins 208*a* and 208*b* detect the liquid level of a predetermined height. That is, the controller 500 supplies the liquid until the liquid level inside head tank 35 reaches to a predetermined height position.

Then, when the air release unit 207A is closed and a predetermined amount of liquid is discharged or returned to the main tanks 50*y*, 50*m*, 50*c*, and 50*k* form the head tank 35, the pressure inside the head tank 35 becomes a predetermined negative pressure value, and the controller 500 can control the liquid amount of the first chamber 202A and the second chamber 202B of the head tank 35 to be the fill-up position that can obtain a predetermined value of negative pressure (i.e., the fill-up position is considering to be at the negative pressure).

Next, a relationship between a change of the liquid discharge amount from the head tank 35 with the change of the negative pressure inside the head tank 35 and a displacement of the first feeler 205A and the second feeler 205B will now be described with reference to FIG. 11 and FIG. 12.

Figure 11:
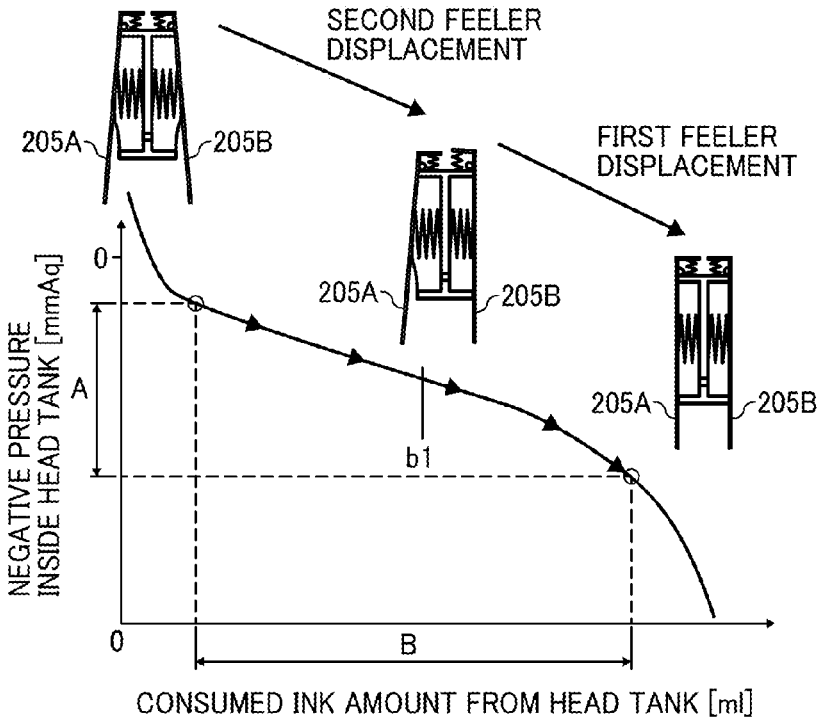
FIG. 11 is an explanatory view for explaining a relationship between a change in a negative pressure and a displacement of a feeler when a discharge amount from the head tank increases.

FIG. 11 shows the displacement of the first feeler 205A and the second feeler 205B while the liquid discharge amount and the negative pressure inside the head tank 35 change by discharging liquid from the head tank 35. FIG. 12 shows the displacement of the first feeler 205A and the second feeler 205B while the liquid discharge amount and the negative pressure inside the head tank 35 change by supplying liquid to the head tank 35 from the main tanks 50*y*, 50*m*, 50*c*, and 50*k*.

Because the first chamber 202A and the second chamber 202B of the head tank 35 are connected via the liquid path 212, the pressure inside the first chamber 202A and the second chamber 202B become the same pressure. Further, the pressing force of the first spring 204A is greater than the pressing force of the second spring 204B.

Therefore, as shown in FIG. 11, if the liquid inside the head tank 35 is discharged, the second film 203B of the second chamber 202B deforms toward an inside of the head tank 35 first as the pressing force of the second spring 204B of the second chamber 202B is smaller than the pressing force of the first spring 204A of the first chamber 202A, and the second feeler 205B, which contacts the second film 203B, displaces.

Then, when the liquid remaining amount in the second chamber 202B of the head tank 35 become equal to or below a predetermined amount, the first film 203A of the first chamber 202A starts to deform toward an inside of the head tank 35 (to deform in a contraction direction) from a position of the liquid discharge amount b1 shown in FIG. 11 where the negative pressure inside the head tank 35 become greater than the pressing force of the first spring 204A that presses the first film 203A. Then, the first spring 204A also starts to deform toward an inside of the head tank 35 (deform in a contraction direction). Then, the liquid inside the first chamber 202A is discharged.

The pressing force of the first spring 204A when the first chamber 202A is in the fill-up state can be equal to the pressing force of the second spring 204B when the second feeler 205B displaces to the position where the second feeler 205B contacts with a part of the tank case 201 of the head tank 35 and stops displacing.

In this case, when the liquid inside the head tank 35 is discharged, and after the second feeler 205B displaces to the position where the second feeler 205B contacts with a part of the head tank 35 and stops displacing, the first feeler 205A starts to displace.

Figure 12:
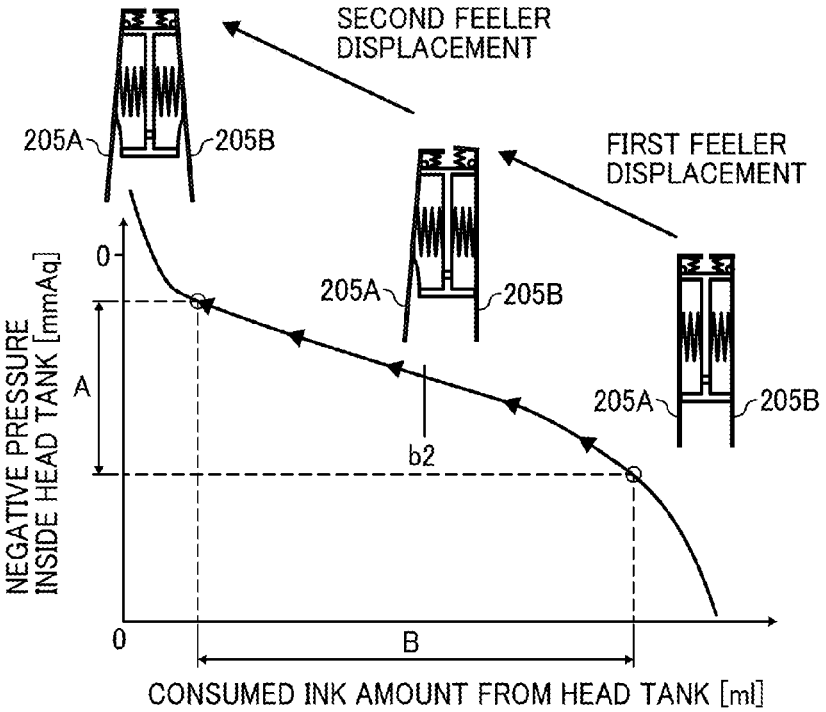
FIG. 12 is an explanatory view for explaining a relationship between a change in a negative pressure and a displacement of a feeler when a filling amount to the head tank increases.

On the other hand, as shown in FIG. 12, when filling (supply) liquid inside the tank 35, the first spring 204, which pushes the first film 203A outward with a strong pressing force, starts to expand first. Then, liquid is filled inside the first chamber 202A, and the first feeler 205B starts to displace first.

Next, with the progress of filling of the liquid inside the head tank 35, the negative pressure inside the head tank 35 decreases. Then, the second film 203B of the second chamber 202B starts to deform outward of the head tank 35 by the pressing force of the second spring 204B from a position of the liquid discharge amount b2 shown in FIG. 12, where the negative pressure inside the head tank 35 becomes smaller than the pressing force of the second spring 204B that presses the second film 203B. Then, the second feeler 205B also starts to displace outward of the head tank 35.

Figure 13:
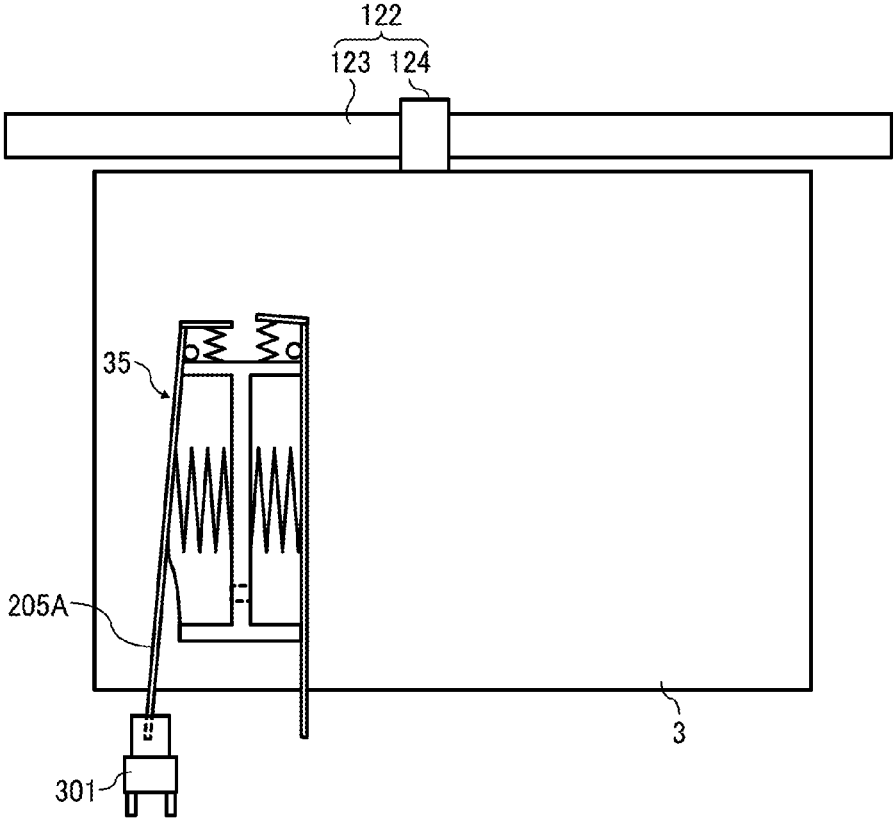
FIG. 13 is a schematic plan view for explaining a control of a liquid supply operation during a carriage scanning operation.

Thus, the head tank 35 of the present embodiment has a configuration such that the first feeler 205A displaces if the liquid is discharged from or filled to the head tank 35 when the negative pressure inside the head tank 35 is greater than the predetermined value, and the second feeler 205B displaces when the negative pressure inside the head tank 35 is equal to or below the predetermined value Next, a control of a liquid supply operation during carriage scanning is explained using FIG. 13. FIG. 13 is a schematic plan view for explaining the control of a liquid supply operation during a carriage scanning operation.

The liquid discharger 800 includes the body side sensor 301 disposed on the apparatus body 101 to detect the first feeler 205A. Further, the liquid discharger 800 includes the linear encoder 122 to detect the position of the carriage 3 in the main scanning direction. The position of the main scanning direction of the carriage 3 is detected by processing detected pulses output from the encoder sensor 124 of the linear encoder 122.

Thus, for example, the position of the main scanning direction of the carriage 3 (hereinafter, merely referred as "carriage position"), when the body side sensor 301 detects the first feeler 205A, is detected by the linear encoder 122. The detected carriage position is stored by the controller 500.

Next, the carriage 3 is scanned, and the carriage position, when the body side sensor 301 detects the first feeler 205A, is detected again, and it is thereby possible to detect that the first feeler has displaced from the difference between the carriage position at a last time and the carriage position at this time.

Further, it is possible to detect a liquid remaining amount in the head tank 35 even when the carriage is scanning by obtaining a correlation between the position of the first feeler 205A detected by the carriage position and the liquid remaining amount of the head tank 35 beforehand.

Here, the first feeler 205A and the second feeler 205B of the head tank 35 mounted on the carriage 3 can flap because of a vibration generated by the scanning operation of the carriage 3 or an inertial force applied on the first feeler 205A and the second feeler 205B generated by the scanning operation of the carriage 3.

However, the pressing force of the first spring 205A that presses the first film 203A is greater than the pressing force of the second spring 205A that presses the second film 203A in the present embodiment. Furthermore, the pressing force of the third spring 210A that presses the first feeler 205A on the first film 203A can be greater than the pressing force of the fourth spring 210B that presses the second feeler 205B on the first film 203B in the present embodiment.

Therefore, the first feeler 205A flaps less and is more stably behaved than the second feeler 205B during the scanning operation of the carriage 3. Thus, the first feeler 205A displaces according to the liquid amount inside the head tank 35 without separating from the first film 203A. In other words, the first feeler 205A displaces according to the deformation of the first film 203A by contacting the first film 203A during the scanning operation of the carriage 3.

Thereby, the body side sensor 301 can correctly detect the first feeler 205A of the head tank 35 mounted on the carriage 35 even during the scanning operation of the carriage 3 to detect a displacement and an amount of displacement of the first feeler 205A.

Therefore, the controller 500 starts to supply liquid to the head tank from the main tanks 50*y*, 50*m*, 50*c*, and 50*k* when the body side sensor 301 detects that the first feeler 205A has displaced during the scanning operation of the carriage 3 and the amount of displacement of the first feeler 205A become a predetermined value, for example.

In this case, the amount of displacement of the first feeler 205A is measured from a reference position, which is the position of the first feeler 205*a* when the first feeler starts to displace, for example. The controller 500 can start to supply the liquid to the head tank 35 when the liquid inside the head tank 35 is consumed by a predetermined amount and the amount of displacement of the first feeler 205A becomes the predetermined amount.

Then, the first feeler starts first to displace in the direction in which the liquid remaining amount increases by the increase of the liquid amount inside the head tank 35 by the liquid supply operation. As explained above, the controller 500 stops the liquid supply operation when the first feeler 205A ceases from displacing or a predetermined amount of liquid has been supplied after the first feeler 205A ceases from displacing.

In this way, the liquid discharger 800 of the present embodiment can supply the liquid to the head tank 35 while controlling the liquid remaining amount inside the head tank 35 to be equal to or more than the predetermined amount without interrupting the scanning operation of the carriage 3.

Therefore, the liquid discharger 800 can control the liquid supply operation using the body side sensor 301 disposed on the apparatus body 101, and it is not necessary to include a detector mounted on the carriage 3 for detecting the first feeler 205A, and the liquid discharger 800 thus has a simple configuration.

The head tank 35 of the first embodiment further includes a second feeler 205B.

After the discharge operation (such as a printing operation) from the head 34 is finished, the controller 500 scans the carriage 3 with a scanning speed smaller than a scanning speed during performing the discharge operation to detect the second feeler 205B by the body side sensor 301. Because the carriage speed during detecting the second feeler 205B is slow, the second feeler 205B does not flap, or the amount of flap of the second feeler 205B is small. Thus, the body side sensor 301 can correctly detect the second feeler 205B.

The controller 500 thus can perform the liquid filling operation to the head tank 35 while controlling the liquid supply to the head tank 35 based on the detection results of the second feeler 205B.

Because the pressing force of the second spring 204B is smaller than the pressing force of the first spring 204A, the second feeler 204B can be displaced with higher precision in response to a change of liquid remaining amount than the first feeler 204A.

Therefore, the liquid discharger 800 can control the liquid amount inside the head tank 35 within all ranges from the liquid supply upper position to the liquid consumption lower limit position LL as shown in FIG. 9.

Thus, the head tank 35 can supply the liquid with the liquid amount previously filled to the filled-up position for printing with a low printing ratio, such as a document only including characters, which requires small liquid amounts for printing images. On the other hand, because the controller intermittently repeats the liquid supply operation to the head tank 35 by driving the liquid feed pump 252 during the printing operation only when the images with high printing ratio, such as photo images is printed. Thus, the deterioration of the liquid feed pump 252 can be restrained.

Figure 14:
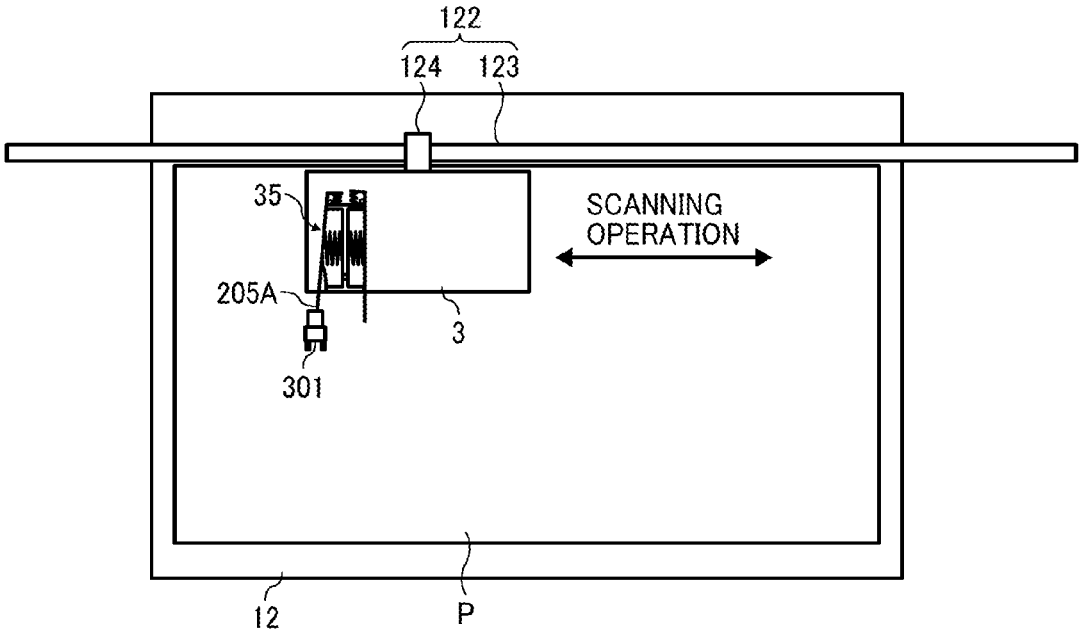
FIG. 14 is explanatory plan view for explaining a liquid amount since a start of displacement of a first feeler of a head tank and until a liquid remaining amount inside a head tank becomes a liquid consumption lower limit value.

FIG. 14 is explanatory plan view during the scanning operation of the carriage 3. FIG. 14 illustrates a liquid amount inside the head tank 35 since a start of displacement of the first feeler 205A of the head tank 35 until the liquid remaining amount inside the head tank 35 become a liquid consumption lower limit value.

As described above, the body side sensor 301 disposed at the apparatus body 101 side detects the first feeler 205A of the head tank 35 mounted on the carriage 3. Further, the linear encoder 122 detects the position of the carriage 3 when the body side sensor 301 detects the first feeler 205A.

Therefore, a position detection of the first feeler 205A, which is detected as the position of the carriage 3, is performed when the first feeler 205A passes through the body side sensor 301 during the scanning operation of the carriage 3 as shown in FIG. 14.

In this case, because the carriage 3 continues to scan in the main scanning direction after the body side sensor 301 detects the first feeler 205A, it is determined whether the liquid supply operation to the head tank 35 should be performed when the body side sensor 301 detects the first feeler 205A again.

Therefore, if the amount of liquid discharged from the head 34, during a time period from the first time of detection of the first feeler 205A by the body side sensor 301 to the second time of detection of the first feeler 205A by the body side sensor 301, is large, the head 34 discharges the liquid more than a predetermined amount such that the liquid amount inside the head tank 35 become less than the liquid consumption lower limit. Thus, the negative pressure inside the head tank 35 become excessive. The excessive negative pressure will generate a discharge failure of the head 34 because the air is sucked from the nozzle 34*n* of the head 34 by the excessive negative pressure inside the head tank 35 and the air inside the nozzle 34*n* blocks the liquid to be passed through the nozzle 34*n*.

Thus, the head tank 35 is configured such that the head tank 35 can contain a possible discharge liquid amount that is greater than a maximum liquid discharge amount.

The possible discharge liquid amount corresponds to a difference of liquid amounts between the liquid remaining amount of the head tank 35 when the first feeler 205A starts to displace and the liquid amount of the head tank 35 at the liquid consumption lower limit, which corresponds to a possible discharge liquid amount.

The maximum liquid discharge amount is the largest liquid amount that can be discharged from the head 34 during a time period from the first time of detection of the first feeler 205A by the body side sensor 301 to the second time of the detection of the first feeler 205A by the body side sensor 301.

Further, it is possible to configure the apparatus body 101 that limits the maximum liquid discharge amount discharged from the head 34 to be less than the possible discharge liquid amount.

That is, the liquid remaining amount inside the head tank 35 is maintained to be greater than the liquid amount of the liquid consumption lower limit even if the head 34 discharges the liquid amount of the maximum liquid discharge amount after the first feeler 205A starts to displace.

Thus, it is possible to prevent the discharge failure from occurring by sucking air into the nozzle 34*n* even if the liquid discharger 800 prints images with a higher printing ratio that may cause an excessive negative pressure inside the head tank 35.

Specifically, it is preferable to set the possible discharge amount to be equal to or more than twice the maximum liquid discharge amount discharged from the head 34 during a time period from the first time of detection of the first feeler 205A by the body side sensor 301 to the second time of the detection of the first feeler 205A by the body side sensor 301 while the carriage 3 scans in the main scanning direction.

Thereby, it is possible to maintain a condition that the head tank 35 contains a liquid amount greater than the liquid consumption lower limit value at the second time of the detection of the first feeler 205A by the body side sensor 301, even if the liquid remaining amount in the first chamber 202A is less than the filled-up condition when the first feeler 205A has already displaced at the first time of detection of the first feeler 205A by the body side sensor 301.

Next, the start and end of the liquid supply operation to the head tank 35 will be explained.

The liquid supply operation to the head tank 35 during the scanning operation of the carriage 3 is performed according to following steps. First, the body side sensor 301 detects the first feeler 205A during the scanning operation of the carriage 3. Then the controller 500 starts the liquid supply operation (liquid filling operation) by driving the liquid feed pump 252 when the controller 500 judges that the position of the first feeler 205A becomes the predetermined position corresponds to the liquid consumption lower limit position LL where the negative pressure inside the head tank 35 become the lowest value in the predetermined negative pressure control range A in FIG. 9.

Further, an upper limit of a liquid filling amount (liquid supply amount) to be filled inside the head tank 35 by the liquid filling operation (liquid supply operation) is determined based on the liquid filling amount corresponding to the difference of the negative pressure between the lower limit value of the negative pressure and the upper limit value of the negative pressure inside the head tank 35. Specifically, the controller 500 supplies liquid to the head tank 35, the amount of which is greater than the liquid amount corresponding to a displacement amount of the first feeler 205A from a position of the first feeler 205A when the first chamber 202*a* is in a filled-up state to the position of the first feeler 205A when a negative pressure inside the head tank 35 is the lower limit value.

Further, a supply flow, which is the same as a supply speed, is set to be greater than a flow of liquid discharged by the head 34 from the head tank 35.

Specifically, a liquid filling amount to be filled inside the head tank 35 during a time period from the first time of detection of the first feeler 205A by the body side sensor 301 to the second time of the detection of the first feeler 205A by the body side sensor 301 is set to be greater than the liquid discharge amount, which is a maximum amount of liquid possible to be discharged from the head 34 during a time period from the first time of detection of the first feeler 205A by the body side sensor 301 to the second time of the detection of the first feeler 205A by the body side sensor.

Thereby, even if the head 34 discharges the maximum amount of liquid possible to be discharged from the head 34 during a time period from the first time of detection of the first feeler 205A by the body side sensor 301 to the second time of the detection of the first feeler 205A by the body side sensor, the liquid discharger 800 can continue the printing operation without interrupting the printing operation because the liquid amount inside the head tank 35 will not fall below the liquid consumption lower limit value, and thus the negative pressure inside the head tank 35 will not become excessive.

Figure 15:
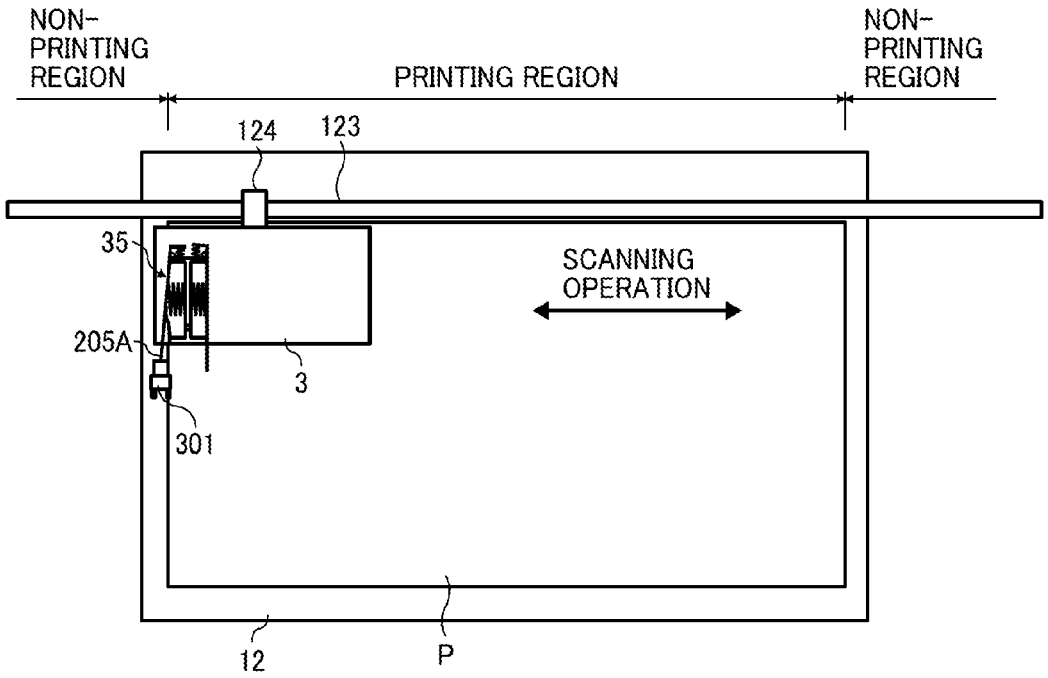
FIG. 15 is an explanatory plan view for explaining a second embodiment.

FIG. 15 is an explanatory plan view for explaining a second embodiment of the present disclosure. FIG. 15 explains an arrangement and a position of the body side sensor 301 in the liquid discharger 800 of the present embodiment.

First, in the first embodiment explained above, the body side sensor 301 is disposed at a printing region, where the head can discharge liquid to the sheet P, as shown in FIG. 14.

The carriage 3 scans with a uniform velocity in the printing region. Thus, in this uniform velocity region of the carriage 3, the carriage 3 stably behaves in order to discharge liquid droplets at a target position while discharging liquid from the head 34.

Because the behavior of the carriage 3 is stable in the uniform velocity region of the carriage 3, the behavior of the first feeler 205A is also stable, which reduces the possibility of causing detection failure of the position of the first feeler 205A. Therefore, it is preferable to dispose the body side sensor 301, which detects the first feeler 205A, in the printing region.

On the other hand, in the second embodiment, the body side sensor 301 is disposed at the boundary region located between the printing region and non-printing region. Here, the printing region is an area where the head 34 can discharge liquid on to the sheet P, and the non-printing region is an area where the head 34 cannot discharge liquid on to the sheet P.

In other words, the body side sensor 301 is disposed at the boundary region (or region near the boundary region) between the uniform velocity region and an acceleration region. Here, the acceleration region is an area where the carriage 3 accelerates or slows down its velocity in order to reverse the scanning direction of the carriage 3.

The first feeler 205A does not substantially displace in the region located between a position of the carriage 3 when the body side sensor 301 detects the first feeler 205A in a first scanning direction in the scanning operation of the carriage 3 and a position of the carriage 3 when the body side sensor 301 detects the first feeler 205A again in a second scanning direction in the scanning operation of the carriage 3, which is a reverse direction to the first scanning direction.

The head 34 does not discharge liquid or discharges liquid of a very small amount as an idle discharge to the idle discharge receiver 28 for a maintenance purpose in the above region. The meaning of "the first feeler 205A does not substantially displace" includes that an amount of displacement of the first feeler 205A is very small so that the body sensor 301 cannot detect the position change of the first feeler 205A.

In the second embodiment, the controller 500 determines a timing of a start of the liquid supply operation by obtaining and comparing samples of the position of the carriage 3 when the body side sensor 301 detects the first feeler 205A in the first scanning direction and the position of the carriage 3 when the body side sensor 301 detects the first feeler 205A in the second scanning direction.

In this case, the controller 500 adapts a position sample near the liquid consumption lower limit position LL to determine the liquid consumption lower limit position LL at which the negative pressure inside the head tank 35 become the strongest value. Further, the controller 500 adapts a position sample near the liquid supply upper limit position UL when the controller 500 determines the liquid supply upper limit position UL at which the negative pressure inside the head tank 35 become the weakest value and near the atmospheric pressure during the liquid supply operation.

Thereby, the liquid discharger of the present embodiment has a failsafe ability to prevent a delay of starting a liquid filling operation or an excess of liquid filling while detecting the first feeler 205A during the scanning operation of the carriage 3. The cause of the delay of starting of the liquid filling operation or the excess of liquid filling is such that a detected position of the first feeler 205A varies by the vibration of first feeler 205A generated by the behavior of the carriage 3 during the scanning operation.

Further, the body side sensor 301 can detect both edges of the first feeler 205A in the thickness direction of the first feeler 205A. Then, it is possible to extract four samples of the positions of the first feeler 205A such that inside and outside positions of the first feeler 205A in the first scanning direction of the carriage 3, and inside and outside positions of the first feeler 205A in the second scanning direction of the carriage 3, the direction of which is a reverse direction to the first scanning direction. Thus, the delay of starting the liquid filling operation or the excess of liquid filling can be prevented.

Further, this embodiment can compare four detected position samples and stop printing when it is judged that the positions of the first feeler 205A cannot be detected accurately, e.g., when the deviation of the four detected positions samples are greater than the predetermined value.

Further, if one sample deviates from the predetermined value, the controller 500 judges that a detection failure has occurred on the position detection of the first feeler 205A when obtaining this one sample. Then, the controller 500 extracts the detected position sample near the liquid consumption lower limit position LL and extracts the detected position sample near the liquid supply upper limit position UL at the time of the liquid filling operation. Thereby, it is possible to perform the liquid supply operation properly by excluding the position samples having detection failures.

Next, the liquid consumption lower limit value, which is used for judging that the position of the first feeler 205A is at a liquid supply start position, and a first chamber liquid filled-up position, which is used for judging that the position of the first feeler 205A is at a liquid filled-up position, will be described.

When filling-up the inside of the head tank 35 with liquid, first, the controller 500 fills the liquid inside the head tank 35 while releasing the interior of the head tank 35 to the atmosphere disposed at a side of the tank case 201. Second, the controller 500 discharges a predetermined amount of liquid from the head tank 35 to generate a weak negative pressure inside the head tank 35, as explained above. The position of the first feeler 205A at this time is the liquid supply upper limit position UL, which is the filled-up position of the head tank 35.

By detecting positions of the first feeler 205A and the second feeler 205B in this condition (when the position of the first feeler 205A is at the liquid supply upper limit position UL), the controller 500 detects the position of the first feeler 205A, when the first chamber 202A is in the filled-up condition, and the positions of the second feeler 205B, when the second chamber 202B is in the filled-up condition, and stores each position as filled-up positions.

Then, the controller sets the liquid consumption lower limit position LL to be a position determined by deducting a quantitative value from the stored position of the first feeler 205A (when the position of the first feeler 205A is at the liquid supply upper limit position UL). The quantitative value is a liquid amount corresponding to the displacing amount of the first feeler 205A from the liquid supply upper limit position UL to the liquid consumption lower limit position LL.

Further, as another method of setting the liquid consumption lower limit position LL, the controller 500 sucks liquid from the head tank 35 by feeding liquid in reverse from the head tank 35 to the main tank 10 by the liquid feed pump 252 for a liquid discharge amount B, which corresponds to a displacement amount of the first feeler 205A from the liquid supply upper limit position UL to the liquid consumption lower limit position LL. Then, the controller 500 obtains the position where the body side detector 301 detects the first feeler 205A at the liquid consumption lower limit position LL and the position of the second feeler 205B where liquid inside the second chamber 202B is at an end (empty) status and stores these position data.

The controller 500 can thereby set, detect, and judge the liquid supply upper limit position UL and the liquid consumption lower limit position LL for each of the head tanks 35 accurately, even if there is unevenness of shapes and characters in each part of the head tanks 35, the feelers 205A and 205B, the springs 204A and 204B, the films 203A and 204B, or unevenness occurring during assembly of the parts described above.

Figure 16:
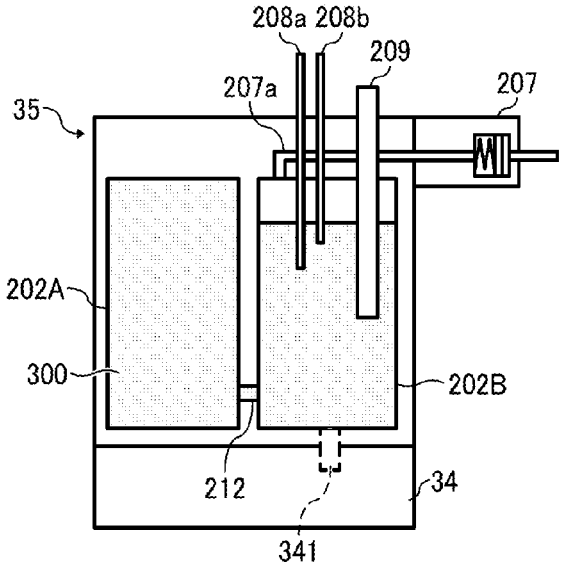
FIG. 16 is a schematic side view for explaining a third embodiment.

Next, a third embodiment of the present disclosure will be explained with reference to FIG. 16. FIG. 16 is an explanatory side view for explaining a third embodiment of the present disclosure.

The head tank 3 in FIG. 16 includes a supply inlet 209, electrode pins 208*a* and 208*b*, an air release unit 207B, and a discharge outlet 341, which functions as a supply inlet to supply liquid to the head tank 35, only on the second chamber 202B side.

Air can enter inside the supply tube 56 when exchanging the detachable main tanks 50*k*, 50*c*, 50*m*, and 50*y* from the upstream side. Also, air can penetrate through the supply tube 56 over time and flow into and be stored inside the head tank 35. If enough air enters inside the head tank 35, the negative pressure inside the head tank 35 changes by expansion and contraction of air inside the head tank 3 when an environmental temperature changes. The changes in the negative pressure can cause liquid leakage from the nozzles 34*n* of the head 34.

Thus, the controller 500 releases air inside the head tank 35 to the atmosphere by the air release unit 207A when detecting more than predetermined amount of air inside the head tank 35 by the electrode pins 208*a* and 208*b*. Then, the controller 500 supplies liquid to the head tank 35 from the main tanks 50*k*, 50*c*, 50*m*, and 50*y* to fill up the head tank 35 with liquid.

Further, air can be sucked and enter into the head tank 35 through the nozzles 34*n* of the head 34 when there is an excessive negative pressure inside the head tank 35.

Therefore, the supply inlet 209, through which liquid is supplied from the main tanks 50*y*, 50*m*, 50*c*, and 50*k* to the second chamber 202B, and the discharge outlet 341 to discharge liquid from the head tank 35, are disposed on the second chamber 202B that has the air release unit 207B.

Further, the liquid path 212, which connects the first chamber 202A and the second chamber 202B, is disposed at a position lower than the surface of the liquid stored inside the head tank 35. Preferably, the liquid path 212 is disposed at a position close to the bottom face of the second chamber 202B.

Thereby, air does not enter the first chamber 202A, and air entering inside the head tank 35 is stored only inside the second chamber 202B, so that it is easy to control the amount of air inside the head tank 35.

Further, the head tank 3 can include the supply inlet 209, the electrode pins 208*a* and 208*b*, the air release unit 207A, and the discharge outlet 341 only on the first chamber 202A side instead of the second chamber 202B side.

Figure 17:
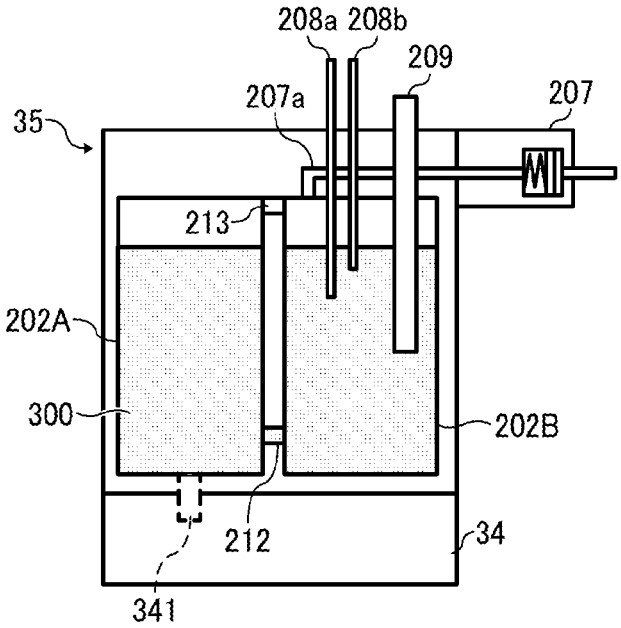
FIG. 17 is a schematic side view of a head tank in a fourth embodiment.

Next, a fourth embodiment of the present disclosure will be explained with referring to FIG. 17. FIG. 17 is an explanatory side view for explaining a fourth embodiment of the present application.

The head tank 3 in FIG. 17 includes a supply inlet 209, electrode pins 208*a* and 208*b*, an air release unit 207B on the second chamber 202B side and includes a discharge outlet 341, which functions as a supply inlet to supply liquid to the head tank 35 on the first chamber 202B side.

Further, head tank 35 has a liquid path 212, which connects the first chamber 202A and the second chamber 202B, at a lower part of the partition wall 201*a*. The head tank 35 further has a liquid path 213, which connects the first chamber 202A and the second chamber 202B, at an upper part of the partition wall 201*a*. The liquid path 213 is displaced near the top surface of the first chamber 202A and the second chamber 202B. Therefore, each of the liquid paths 212 and the 213 connects the first chamber 202A and the second chamber 202B at different heights.

Thus, if the discharge outlet 341 is disposed at one of the first chamber 202A and the second chamber 202B of the head tank 35, and the supply inlet 209 is disposed at another one of the first chamber 202A and the second chamber 202B of the head tank 35, air can enter any one of the first chamber 202A and the second chamber 202B. Also, air can penetrate through the film 203, and once air enters into one of the first chamber 202A and the second chamber 202B that does not have the air release unit 207B, it is difficult to discharge air from the first chamber 202A or the second chamber 202B that does not have the air release unit 207B.

Therefore, the head tank 35 further has a liquid path 213, which connects an upper part of the first chamber 202A and the second chamber 202B, where air is easily stored. Air stored in the first chamber 202A or the second chamber 202B that does not have the air release unit 207A can be discharged through the air release unit 207A.

Figure 18:
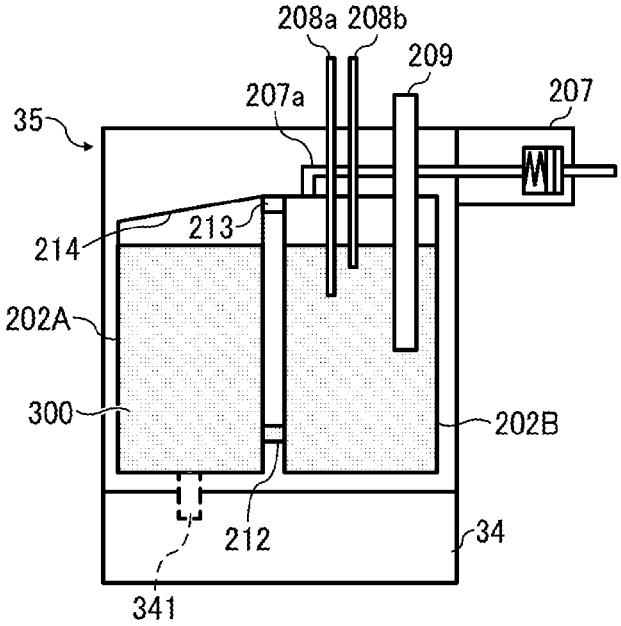
FIG. 18 is a schematic side view of a head tank in a fifth embodiment.

Next, a fifth embodiment of the present disclosure will be explained with referring to FIG. 18. FIG. 18 is an explanatory side view for explaining a fifth embodiment of the present disclosure.

This head tank 35 has almost the same configuration as in the above fourth embodiment. The only difference is that the first chamber 202A, which does not have the air release unit 207A, has a sloped face 214 that gradually increases in height toward the liquid path 213 on the top face of the first chamber 202A.

Thereby, it is possible to quickly move the air from inside the first chamber 202A to the second chamber 202B through the liquid path 213.

Figure 19B:
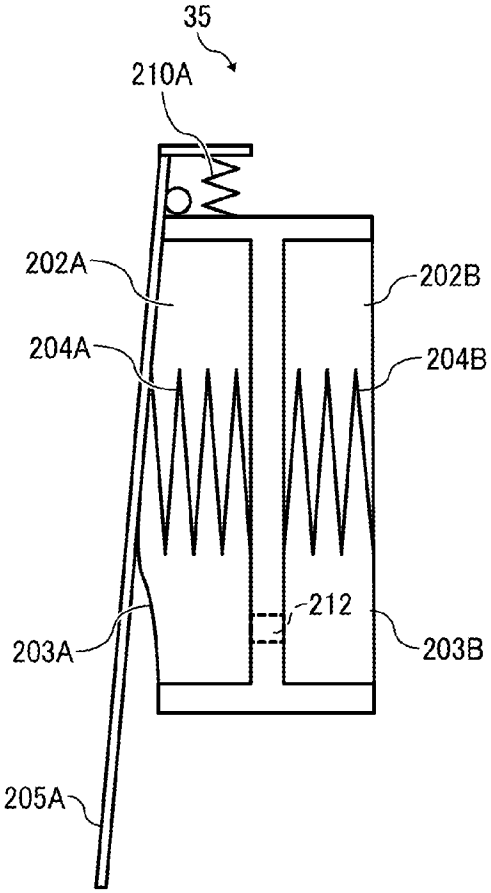
FIGS. 19A and 19B are schematic plan views of a head tank in a sixth embodiment.
Figure 19A:
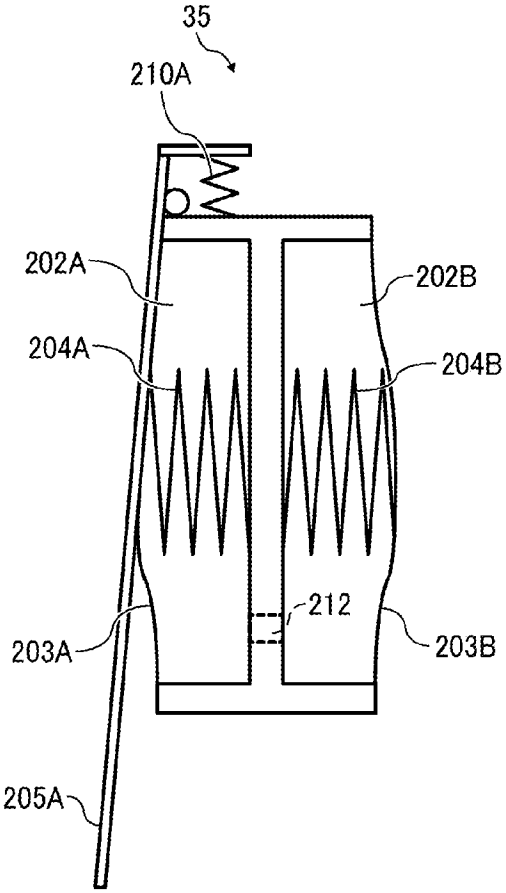

Next, a sixth embodiment of the present disclosure will be explained with referring to FIGS. 19A and 19B. FIGS. 19A and 19B are an explanatory plan views for explaining a sixth embodiment of the present disclosure.

The head tank 35 has a different configuration from the first embodiment shown in FIG. 4 such that the second chamber 202B does not have the second feeler 205B and the second spring 210B.

Even in this configuration, the behavior of the displacement of the first feeler 205A of the first chamber 202A is the same as that shown in the first embodiment shown in FIG. 4.

Therefore, it is possible to always keep more than a required amount of liquid inside the liquid containing part 202 formed by the first chamber 202A and the second chamber 202B of the head tank 35 by detecting the displacement of the first feeler 205A and controlling the liquid supply operation from the main tanks 50*y*, 50*m*, 50*c*, and 50*k* to the head tank 35.

In this disclosure, "the liquid discharger" indicates an apparatus that includes a liquid discharge head or a liquid discharge unit and drives the liquid discharge head or the liquid discharge unit in order to eject the liquid. An apparatus that is able to eject the liquid to a medium (object) to which the liquid can adhere can be used as the liquid discharger.

"The liquid discharger" can include the liquid discharge head or the liquid discharge unit, a controller configured to control an operation of the liquid discharger, and devices configured to feed, convey, and discharge the object to which the liquids adhere, and another type of apparatus, such as a preprocessing apparatus and a post processing apparatus.

Further, a recording apparatus, a printing apparatus, an image forming apparatus, a liquid droplets discharge apparatus, a liquids discharge apparatus, a process liquids coating apparatus, a solid shaping apparatus, an apparatus that generates minute particles by a spray granulation method, a printer, a multifunction peripheral (MFP), a three-dimensional (3D) printer etc. can include "the liquid discharger."

Further, "the liquid discharger" is not limited to an apparatus that generates meaningful images, such as characters and figures by discharging liquid. For example, an apparatus that generates meaningless images, such as patterns or three-dimensional images can include the liquid discharger.

The above-described "medium to which the liquids can adhere" indicates a medium to which the liquids can adhere even temporarily. The "medium to which the liquids can adhere" can be made of a material, to which the liquids can adhere even temporarily, such as paper, string, fiber, cloth, leather, metal, plastic, glass, timber, and ceramic.

Further, ink, process liquid, DNA samples, a resist, a pattern material, a binding agent, a shaping liquid, etc. can be used for the "liquids".

Further, a serial-type apparatus that moves the liquid discharge heads or a line-type apparatus that does not move the liquid discharge heads can be used as "the liquid discharger," unless limited specifically.

"The liquid discharge unit" includes the liquid discharge head(s), another functional part, and another mechanism, and includes an aggregation of parts that correspond to the discharge of the liquids. For example, "the liquid discharge unit" can include a configuration in which at least one of a head tank, a carriage, a supplying mechanism, a maintenance mechanism, and a main scanning movement mechanism is combined with the liquid discharge head.

The main scanning movement mechanism is a mechanism for moving the liquid discharge head(s) in the main scanning direction. For example, the main scanning movement mechanism can be constructed by combining a guide member that guides the liquid discharge head or the carriage, the driving source, and a movement mechanism of the carriage. The guide member, which is a single body, can be included in the main scanning movement mechanism.

The supplying mechanism is a mechanism for supplying the liquids stored outside of the liquid discharge head to the liquid discharge head. For example, the supplying mechanism can include a mounting portion for mounting a liquid cartridge and a tube. Further, the tube or the mounting portion can be included in the supplying mechanism.

The maintenance mechanism is a mechanism for performing maintenance and recovery of the capability of the liquid discharge head(s). For example, the maintenance mechanism can have a configuration in which at least two of a cap, a wiping member, a suction unit connected to the cap such as a suction pump, and an idle receiving portion are combined.

For example, a mechanism in which the liquid discharge head and another functional part/mechanism are integrated can have a fasten member, glue or heat caulking for fixing, a tube for connecting, or members engaging each other (including members in which one member slidably engages with the other member). Further, the present disclosure is not limited to the configuration in which the liquid discharge head and the other functional part/mechanism are fixed, connected, or engaged, directly. The present disclosure can use a configuration in which the liquid discharge head and the other functional part/mechanism are fixed, connected, or engaged via an intermediate member.

For example, a configuration in which the liquid discharge head and the head tank are fixed with the fasten member, the glue, or the like in order to integrate the liquid discharge head and the head tank can be used for the liquid discharge unit. Further, a configuration in which the liquid discharge head and the head tank are connected to each other by the tube or the like in order to integrate the liquid discharge head and the head tank can be used for the liquid discharge unit. Further, the liquid discharge unit can include a filter between the head tank and the liquid discharge head.

Further, a configuration in which the liquid discharge head and the carriage are fixed with the fasten member, the glue, or the like in order to integrate the liquid discharge head and the carriage can be used for the liquid discharge unit. Further, a configuration in which the liquid discharge head and the carriage are fixed via an attachment member for attaching in order to integrate the liquid discharge head and the carriage can be used for the liquid discharge unit.

Further, a configuration in which the liquid discharge head slidably engages (or attaches) with a guide member forming a part of the main scanning movement mechanism in order to integrate the liquid discharge head and the main scanning movement mechanism can be used for the liquid discharge unit. Further, a configuration in which the carriage, on which the liquid discharge head is attached, slidably engages (or attaches) with the guide member forming the part of the main scanning movement mechanism in order to integrate the liquid discharge head and the main scanning movement mechanism can be used for the liquid discharge unit.

Further, a configuration in which the liquid discharge head and a cap that is a part of the maintenance mechanism are fixed with the fasten member or the like in order to integrate the liquid discharge head and the maintenance mechanism can be used for the liquid discharge unit. Further, a configuration in which the carriage, on which the liquid discharge head is attached, and the cap, which is the part of the maintenance mechanism, are fixed with the fasten member or the like in order to integrate the liquid discharge head and the maintenance mechanism can be used for the liquid discharge unit.

Further, a configuration in which a tube for supplying the liquid from the outside to the inside of the liquid discharge head is connected to the liquid discharge head in order to integrate the liquid discharge head and the supplying mechanism can be used for the liquid discharge unit. Further, a configuration in which a channel part to which the tube is connected is attached to the liquid discharge head in order to integrate the liquid discharge head and the supplying mechanism via the channel part can be used for the liquid discharge unit. Further, a configuration in which the head tank to which the tube is connected is attached to the liquid discharge head in order to integrate the liquid discharge head and the head tank can be used for the liquid discharge unit.

Moreover, a configuration in which the liquid discharge head, the carriage, the main scanning mechanism, the maintenance mechanism and the supplying mechanism are integrated can be used as "the liquid discharge unit."

Further, a pressure generation unit used for "the liquid discharge head" is not limited. For example, other than a piezoelectric actuator (a laminated piezoelectric element can be used) described in above embodiments, a thermal actuator using an electricity-heat conversion element, such as a heat resistance element, or an electrostatic actuator including a vibration plate and a counter electrode can be used.

Further, in this disclosure, the terms image formation, recording, printing, image recording, image printing, shaping, and the like are used herein as synonyms for one another.

Further, the present disclosure is not limited to these embodiments, but various variations and modifications can be made without departing from the scope of the present disclosure.

Additional modifications and variations of the present disclosure are possible in light of the above teachings. It is therefore to be understood that, within the scope of the appended claims, the present inventions can be practiced other than as specifically described herein.

What is claimed is:

1. A liquid container, comprising:

a first chamber and a second chamber to contain liquid to be supplied to a head, wherein the first chamber has a flexible wall and the second chamber has a flexible wall, the first chamber includes a first spring inside the first chamber to press the flexible wall of the first chamber outward, the second chamber includes a second spring inside the second chamber to press the flexible wall of the second chamber outward, and a pressing force of the first spring is greater than a pressing force of the second spring;

a liquid path to connect the first chamber and the second chamber so that liquid communicates between the first chamber and the second chamber; and a first feeler disposed outside the first chamber and in contact with the flexible wall of the first chamber, the first feeler being displaced according to a movement of the flexible wall of the first chamber.

2. The liquid container as claimed in claim 1, further comprising:

a second feeler disposed outside the second chamber and in contact with the flexible wall of the second chamber, the first feeler being displaced according to a movement of the flexible wall of the second chamber.

3. The liquid container as claimed in claim 1, further comprising:

a third spring to press the first feeler against the flexible wall of the first chamber; and a fourth spring to press the first feeler against the flexible wall of the second chamber, wherein a pressing force of the third spring is greater than a pressing force of the fourth spring.

4. The liquid container as claimed in claim 1, wherein the liquid path includes two liquid paths, each connecting the first chamber and the second chamber, the two liquid path being disposed at different heights, and at least one of the two liquid paths is disposed at a top surface of the first chamber and the second chamber.

5. A liquid discharger, comprising:

a head to discharge liquid;

a liquid container to contain liquid to be supplied to the head;

a liquid tank to contain the liquid to be supplied to the liquid container;

a pump to supply the liquid from the liquid tank to the liquid container, wherein the liquid container includes a first chamber and a second chamber to contain liquid to be supplied to a head, wherein the first chamber has a flexible wall and the second chamber has a flexible wall, the first chamber includes a first spring inside the first chamber to press the flexible wall of the first chamber outward, the second chamber includes a second spring inside the second chamber to press the flexible wall of the second chamber outward, and a pressing force of the first spring is greater than a pressing force of the second spring;

a liquid path to connect the first chamber and the second chamber so that liquid communicates between the first chamber and the second chamber; and a first feeler disposed outside the first chamber and in contact with the flexible wall of the first chamber, the first feeler being displaced according to a movement of the flexible wall of the first chamber.

6. The liquid discharger as claimed in claim 5, further comprising:

a carriage that mounts the head and the liquid container and moves in a main scanning direction;

a feeler detector disposed on an apparatus body to detect the first feeler, a carriage position detector to detect a position of the carriage in the main scanning direction; and a controller to control a liquid supply from the liquid tank to the liquid container based on detection of the first feeler by the feeler detector and the detected position of the carriage in the main scanning direction by the carriage position detector during a time when the carriage moves in the main scanning direction.

7. The liquid discharger as claimed in claim 6, wherein an amount of liquid consumable during a first time period, which starts from when the first feeler starts to displace and ends when the first feeler displaces for a predetermined distance, is greater than a largest liquid discharge amount dischargeable from the head during a second time period, which starts from when the feeler detector detects the first feeler while the carriage scans in the main scanning direction and ends when the feeler detector detects the first feeler again.

8. The liquid discharger as claimed in claim 6, wherein the controller supplies an amount of the liquid from the liquid tank to the liquid container while the carriage scans in the main scanning direction, the amount being greater than a largest liquid discharge amount dischargeable from the head during a second time period, which starts from when the feeler detector detects the first feeler while the carriage scans in the main scanning direction and ends when the feeler detector detects the first feeler again.

9. The liquid discharger as claimed in claim 6, wherein the controller stores beforehand a filled-up position of the first feeler when both of the first chamber and the second chamber are filled up; and the controller supplies liquid from the liquid tank to the liquid container until the first feeler displaces to the stored filled-up position, when the feeler detector detects that the first feeler is displaced by a predetermined distance.

10. The liquid discharger as claimed in claim 6, further comprising a second feeler disposed outside the second chamber and in contact with the flexible wall of the second chamber, the second feeler being displaced according to a movement of the flexible wall of the second chamber, wherein the controller stores beforehand a filled-up position of the second feeler when both of the first chamber and the second chamber are filled up; and the controller supplies liquid from the liquid tank to the liquid container until the second feeler displaces to the stored filled-up position, when the feeler detector detects the second feeler by scanning the carriage with a speed slower than a speed at which the carriage scans while discharging liquid from the head.

11. The liquid discharger as claimed in claim 6, wherein the feeler detector is disposed within a region in the apparatus where the carriage scans with a uniform velocity.

12. The liquid discharger as claimed in claim 6, wherein the feeler detector is disposed at a boundary zone disposed between a region where the carriage scans with a uniform velocity and a region where the carriage accelerates or at a boundary zone disposed between a region where the carriage scans with a uniform velocity and a region where the carriage decelerates.

* * * * *